US011952854B2

(12) United States Patent
DeBerry et al.

(10) Patent No.: US 11,952,854 B2
(45) Date of Patent: Apr. 9, 2024

(54) TUBING HANGER ALIGNMENT DEVICE WITH PLUG-BASED ALIGNMENT MECHANISM

(71) Applicant: Dril-Quip, Inc., Houston, TX (US)

(72) Inventors: Blake T. DeBerry, Houston, TX (US); Morris B. Wade, Houston, TX (US); Flavio Santos, Houston, TX (US); Gregory Norwood, Boerne, TX (US); Robert Buxton, Cypress, TX (US); Justin Rye, Houston, TX (US); Todd L. Scaggs, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 0 days.

(21) Appl. No.: 17/874,235

(22) Filed: Jul. 26, 2022

(65) Prior Publication Data

US 2022/0364428 A1 Nov. 17, 2022

Related U.S. Application Data

(63) Continuation of application No. 17/201,465, filed on Mar. 15, 2021, now abandoned, which is a continuation of application No. 17/067,590, filed on Oct. 9, 2020, now Pat. No. 10,947,805, which is a (Continued)

(51) Int. Cl.

| | |
|---|---|
| ***E21B 33/04*** | (2006.01) |
| ***E21B 33/03*** | (2006.01) |
| ***E21B 33/043*** | (2006.01) |

(52) U.S. Cl.

CPC ..... *E21B 33/04* (2013.01); *E21B 33/03* (2013.01); *E21B 33/0407* (2013.01); *E21B 33/043* (2013.01)

(58) Field of Classification Search

CPC ..... E21B 33/04; E21B 33/0415

See application file for complete search history.

(56) References Cited

U.S. PATENT DOCUMENTS

| | | | |
|---|---|---|---|
| 4,067,385 | A | 1/1978 | Schwager et al. |
| 4,109,712 | A | 8/1978 | Regan |
| 4,770,248 | A | 9/1988 | Houlgrave et al. |

(Continued)

FOREIGN PATENT DOCUMENTS

| | | | |
|---|---|---|---|
| GB | 2397312 | A | 7/2004 |
| WO | 2018/226239 | A1 | 12/2018 |

OTHER PUBLICATIONS

Araujo, Gustavo Bellot de Almeida, and Zaragoza Labes. "New subsea X tree generation brings innovative features providing efficiency for ultra deep waters." (2008), 4 pages.

(Continued)

*Primary Examiner* — Giovanna Wright

(74) *Attorney, Agent, or Firm* — Baker Botts L.L.P.

(57) ABSTRACT

Systems and methods for landing a tubing hanger in a wellhead and then orienting a tree (or spool, or flowline connection body) relative to the tubing hanger while landing the tree on the wellhead are provided. This alignment is accomplished without the use of either a tubing spool or a BOP stack with an orientation pin. The tubing hanger alignment devices may be used to orientate the tree as the tree is landed so that the couplings and stabs between the tree and the tubing hanger line up with each other just at the moment of landing.

19 Claims, 15 Drawing Sheets

Related U.S. Application Data continuation of application No. 16/111,987, filed on Aug. 24, 2018, now Pat. No. 10,830,015.

(60) Provisional application No. 62/574,491, filed on Oct. 19, 2017.

(56) References Cited

U.S. PATENT DOCUMENTS

| | | | | |
|---|---|---|---|---|
| 4,903,774 | A * | 2/1990 | Dykes | E21B 33/047 166/368 |
| 5,145,006 | A | 9/1992 | June | |
| 5,247,997 | A | 9/1993 | Puccio | |
| 5,503,230 | A | 4/1996 | Osborne et al. | |
| 6,050,339 | A * | 4/2000 | Milberger | E21B 33/035 166/88.4 |
| 6,488,083 | B2 | 12/2002 | Bartlett et al. | |
| 17,040,412 | | 5/2006 | DeBerry | |
| 8,256,506 | B2 | 9/2012 | Dyson et al. | |
| 8,376,057 | B2 | 2/2013 | Dyson et al. | |
| 8,739,883 | B2 | 6/2014 | Aarnes et al. | |
| 10,947,805 | B2 | 3/2021 | DeBerry et al. | |
| 11,180,968 | B2 | 11/2021 | Mitchell et al. | |
| 2006/0260799 | A1 | 11/2006 | Broussard | |
| 2009/0211761 | A1 | 8/2009 | Broussard | |
| 2010/0078176 | A1 | 4/2010 | Christie | |
| 2010/0307764 | A1* | 12/2010 | Buckle | E21B 33/04 166/372 |
| 2013/0126181 | A1 | 5/2013 | Bell | |
| 2015/0144360 | A1 | 5/2015 | Shearer | |
| 2015/0247371 | A1* | 9/2015 | Kekarainen | E21B 33/043 166/344 |

OTHER PUBLICATIONS

ISO, ISO. "13628-4: Petroleum and Natural Gas Industries-Design and Operation of Subsea Production Systems—Subsea Wellhead and Tree Equipment." ISO-International Organization for Standardization (2011), 276 pages.

Hunting Subsea Technologies, "UO-Series Male Hydraulic Coupling Data Sheet and UO-Series Female Hydraulic Coupling Data Sheet" (no date), 3 pages.

Connector Subsea Solutions, "Hydraulic and Chemical Couplers" (no date), 2 pages.

Dril-Quip, Inc., "Dril-Quip BigBore-lle Wellhead—OTC Spotlight 2017" (2017), 1 page.

* cited by examiner

TUBING HANGER ALIGNMENT DEVICE WITH PLUG-BASED ALIGNMENT MECHANISM

CROSS REFERENCE TO RELATED PATENT APPLICATIONS

The present application is a continuation claiming the benefit of U.S. patent application Ser. No. 17/201,465, entitled "Tubing Hanger Alignment Device," filed on Mar. 15, 2021, which is a continuation claiming the benefit of U.S. patent application Ser. No. 17/067,590, entitled "Tubing Hanger Alignment Device," filed on Oct. 9, 2020, now U.S. Pat. No. 10,947,805, which is a continuation claiming the benefit of U.S. patent application Ser. No. 16/111,987, entitled "Tubing Hanger Alignment Device," filed on Aug. 24, 2018, now U.S. Pat. No. 10,830,015, which claims priority to and the benefit of Provisional Patent Application Ser. No. 62/574,491, entitled "Tubing Hanger Alignment Device," filed on Oct. 19, 2017.

TECHNICAL FIELD

The present disclosure relates generally to wellhead systems and, more particularly, to tubing hanger alignment devices used to properly align a tree to a tubing hanger in a wellhead regardless of the orientation in which the tree is positioned in the wellhead.

BACKGROUND

Conventional wellhead systems include a wellhead housing mounted on the upper end of a subsurface casing string extending into the well bore. During a drilling procedure, a drilling riser and BOP are installed above a wellhead housing (casing head) to provide pressure control as casing is installed, with each casing string having a casing hanger on its upper end for landing on a shoulder within the wellhead housing. A tubing string is then installed through the well bore. A tubing hanger connectable to the upper end of the tubing string is supported within the wellhead housing above the casing hanger for suspending the tubing string within the casing string. Upon completion of this process, the BOP is replaced by a Christmas tree installed above the wellhead housing, with the tree having a valve to enable the oil or gas to be produced and directed into flow lines for transportation to a desired facility.

The tubing hanger contains numerous bores and couplings, which require precise alignment with corresponding portions of the tree. Conventionally, there are two ways to achieve orientation of a tree relative to a tubing hanger. The first uses a tubing spool assembly, which latches to the wellhead and provides landing and orientation features. The tubing spool is very expensive, however, and adds height to the overall stack-up. Additionally, the tubing spool is so heavy that few work class vessels can install it, and it frequently requires installation by expensive drilling vessels. Furthermore, the drilling riser must be removed to install the tubing spool.

The second method of orienting a tree relative to a tubing hanger involves the use of a blowout preventer ("BOP") stack hydraulic pin and orientation adapter joint. This method requires detailed knowledge of the particular BOP stack in order to accurately install a hydraulically actuated pin, which protrudes into the BOP stack bore. An orientation helix is attached above the tubing hanger running tool, and, as the tubing hanger lands, the helix engages the hydraulic pin and orientates the tubing bores to a defined direction. This method requires accurate drawings of the BOP stack elevations and spacing between the main bore and the outlet flanges, which may require hours of surveying and multiple trips to make measurements. Room for error exists with this method, particularly in older rigs. Thus, this method requires significant upfront planning. Additionally, setting the lock-down sleeve in the wellhead generally requires a rig because the BOP must remain in place as a reference point for orientation of the tubing hanger and corresponding lock-down sleeve.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
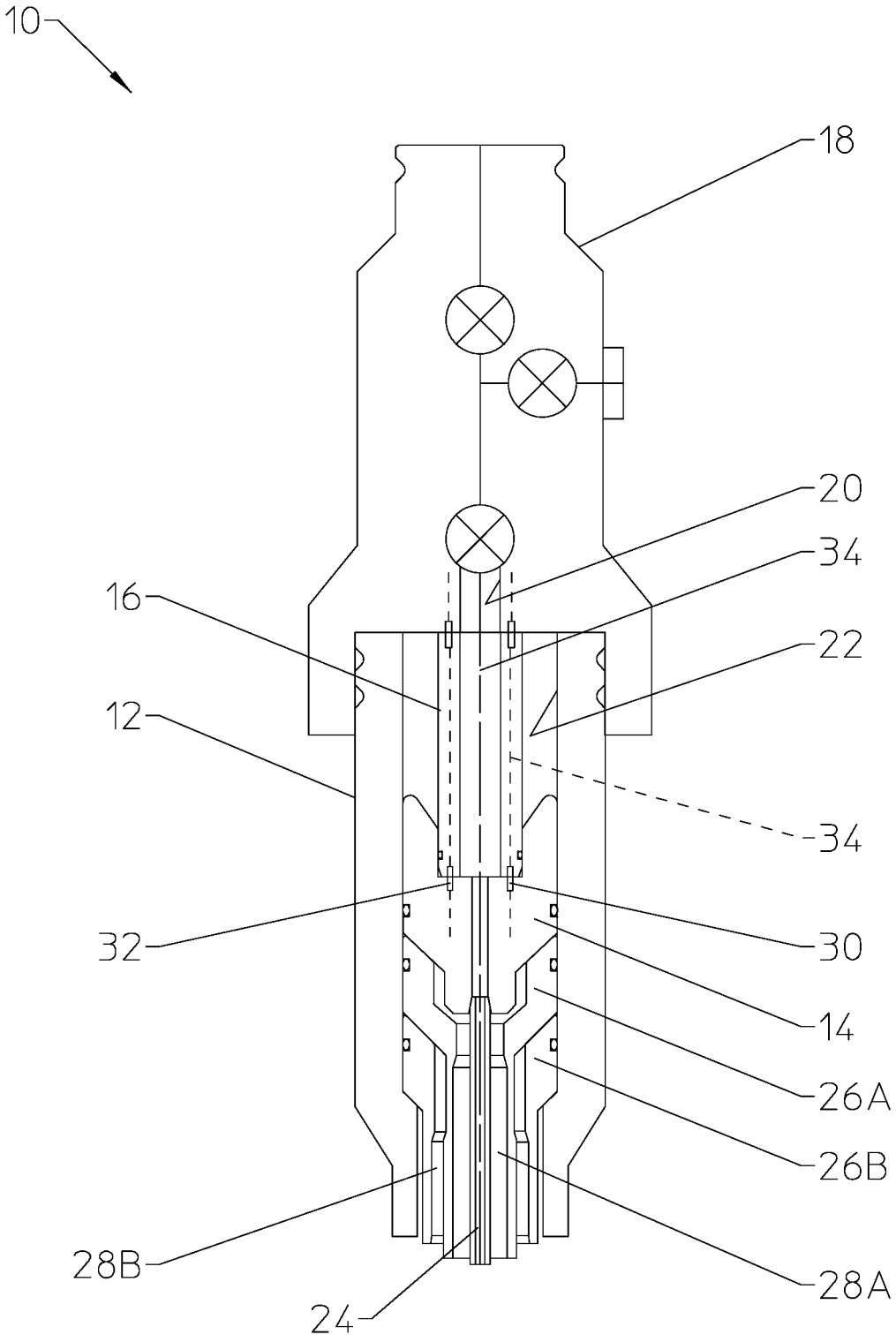
FIG. 1 is a schematic cutaway view of components of a production system having a tubing hanger alignment device, in accordance with an embodiment of the present disclosure.

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

Certain embodiments according to the present disclosure may be directed to a tubing hanger alignment device used to properly orient a tree (or spool, or flowline connection body) that is being landed on a wellhead relative to a tubing hanger that is set in the wellhead.

In the following discussion, the term "tree" will be used to refer to any type of component that is landed on a wellhead, has one or more flowlines extending therethrough, and has one or more communication flow paths (e.g., electric, fiber optic, or hydraulic) for communicating with communication flow paths in the associated tubing hanger. The term "tree" will be used throughout this application to refer to any one of a tree body, a spool, or a flowline connection body.

In wellhead systems, a tree (or spool, or flowline connection body, connector) that is positioned on the wellhead must be properly oriented with respect to the tubing hanger that is set in the wellhead. This is because there are a number of couplings or stabs that have to be made up between the tubing string and the tree so as to allow electric, hydraulic, and/or fiber optic signals to be communicated from the tree to the tubing hanger and various downhole components. Existing methods for orienting a tree relative to a tubing hanger in the wellhead involve the use of either an expensive tubing spool or a BOP stack hydraulic pin and orientation adapter joint, which can be difficult to properly place on the wellhead and expensive to adjust if improperly placed.

The present disclosure is directed to systems and methods for landing a tubing hanger in a wellhead without regard to its orientation and landing a tree at any orientation desired by the operator. The tree can land at any orientation and the systems and methods according to the present invention can be used to orientate the various couplings (e.g., the electric, hydraulic, and/or fiber optic) relative to the tubing hanger while landing the tree on the wellhead. This is accomplished without the use of either a tubing spool or a BOP stack with an orientation pin. This can save the operator a large amount of money (on the order of millions of dollars) since no tubing spool is necessary to perform the orientation. In addition, the disclosed systems and methods will save the operator money because they avoid the possibility of costly remediation associated with an improperly positioned BOP. The tubing hanger alignment devices are able to align the tree to the tubing hanger independent of the original tree orientation at the beginning of the landing process. Essentially, the disclosed tubing hanger alignment devices enable the tree to function as a "self-orienting tree". The tree can be landed in any orientation desired by the operator. The present invention thus provides a self-alignment and orientation of couplings or stabs that have to be made up between the tubing string and the tree so as to allow electric, hydraulic, and/or fiber optic signals to be communicated from the tree to the tubing hanger and various downhole components.

Turning now to the drawings, FIG. 1 illustrates certain components of a subsea production system 10 in which the disclosed tubing hanger alignment devices may be utilized. The production system 10 depicted in FIG. 1 may include a wellhead 12, a tubing hanger 14, a tubing hanger alignment device 16, and a tree 18 (which may be a tree body, a spool, or a flowline connection body). As those of ordinary skill in the art will appreciate, the tubing hanger alignment device 16 may be coupled to the tubing hanger 14 or tree 18 (not shown) prior to landing or alternatively landed independent of both devices (not shown). The tree 18 may include various valves for fluidly coupling a vertical bore 20 formed through the tree 18 to one or more downstream production flow paths, such a well jumper, for example. The tree 18 may be connected to and sealed against the wellhead 12. The tubing hanger 14 may be fluidly coupled to the bore 20 of the tree 18.

As shown, the tubing hanger alignment device 16 may connect the tree 18 to the tubing hanger 14. In other embodiments, the tubing hanger alignment device may include a plug that is removably placed within the tubing hanger 14 at one or more times throughout a completion process, as described below. In such cases, the tubing hanger 14 may be connected to and sealed against the tree 18 via an isolation sleeve that is integral with the tree 18.

The tubing hanger 14 may be landed in and sealed against a bore 22 of the wellhead 12, as shown. The tubing hanger 14 may suspend a tubing string 24 into and through the wellhead 12. Likewise, one or more casing hangers (e.g., inner casing hanger 26A and outer casing hanger 26B) may be held within and sealed against the bore 22 of the wellhead 12 and used to suspend corresponding casing strings (e.g., inner casing string 28A and outer casing string 28B) through the wellhead 12.

In the illustrated embodiment, the tubing hanger alignment device 16 may include one or more communication lines (e.g., hydraulic fluid lines, electrical lines, and/or fiber optic cables) 30 disposed therethrough and used to communicatively couple the tree 18 to the tubing hanger 14. The tubing hanger 14 may include couplings or stabs 32 located at the top of the tubing hanger 14 in a specific orientation with respect to a longitudinal axis 34. The tubing hanger alignment device 16 is configured to facilitate a mating connection that communicatively couples the tree 18 to the couplings/stabs 32 on the tubing hanger 14 as the tree 18 is landed onto the wellhead 12, regardless of the orientation in which the tree 18 is initially positioned during the landing process.

Different arrangements of a tubing hanger alignment device 16 will now be disclosed in the following sections of this description. The tubing hanger alignment device may utilize a coiled tubing alignment mechanism, a helical slot alignment mechanism, a torsional spring alignment mechanism, or a plug-based alignment mechanism.

Coiled Tubing Alignment Mechanism

A tubing hanger alignment device 16 having a coiled tubing mechanism will be described with reference to FIGS. 2 and 3. The tubing hanger alignment device 16 of FIG. 2 includes a mule shoe sub 110, an alignment key 112, a production stab sub 114, and one or more lengths of coiled hydraulic tubing and/or electrical conduits 116. The arrangement and interaction of these components will now be described.

The mule shoe sub 110 may house standard hydraulic, electric, and/or fiber optic couplings 118 that interface with the corresponding couplings/stabs 32 at a top end of the tubing hanger 14 upon landing of the tree 18. The mule shoe sub 110 is generally mounted to the production stab sub 114, as shown. The mule shoe sub 110 may include hydraulic fluid ports and/or electrical cables 120 extending therethrough. The ports and/or cables 120 may be connected to or through the coiled hydraulic tubing and/or electrical conduits 116 at the top of the mule show sub 110 to allow the mule shoe sub 110 to rotate relative to the body of the tree 18. Electrical cables and/or hydraulic ports 120 disposed through the mule shoe sub 110 are terminated to a series of dry mate electric contacts and/or hydraulic connectors 118 that interface with the tubing hanger 14 at the bottom of the mule shoe sub 110.

The mule shoe sub 110 is able to rotate relative to the tree body 18 and the production stab sub 114. A mule shoe profile drives the mule shoe sub 110 to rotate as it is lowered through the wellhead 112. The mule shoe profile 122 is illustrated in FIG. 3. The mule shoe profile 122 is a profile formed about the outer circumference of the mule shoe sub 110, as shown. The mule shoe profile 122 may feature a protruding edge that slopes in a relatively downward direction (arrow 124) from one side of the mule shoe sub 110 in both directions circumferentially around the sub 110 (arrows 126) to an opposite side 128 of the mule shoe sub 110. At the lowest point on the side 128 of the mule shoe profile 122, the profile 122 may include an alignment slot 130. The alignment slot 130 may be oriented in the downward direction (arrow 124).

Figure 2:
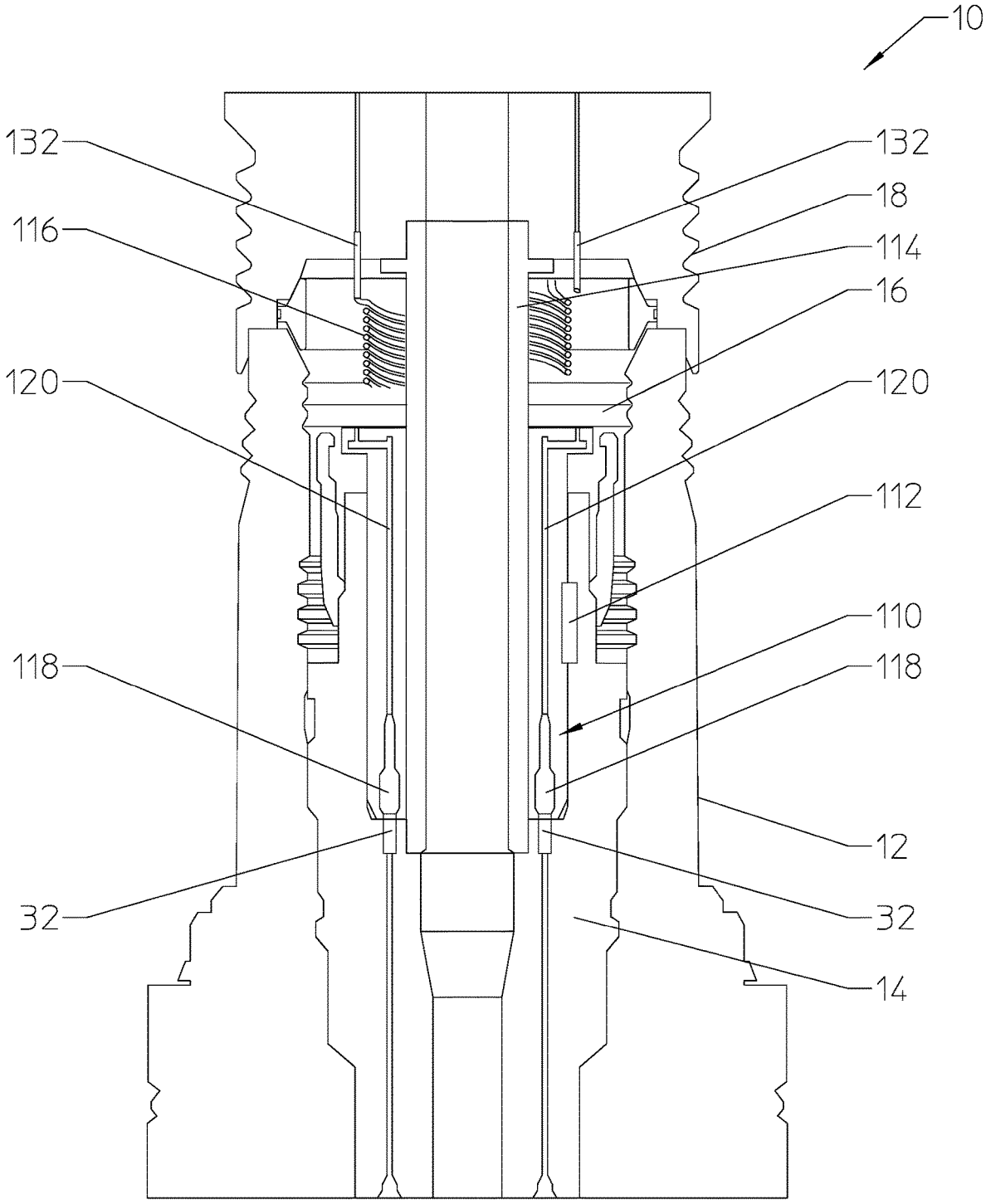
FIG. 2 is a cross-sectional view of a production system comprising a tubing hanger alignment device with a coiled tubing alignment mechanism, in accordance with an embodiment of the present disclosure.

As shown in FIG. 2, the alignment key 112 may be mounted directly to the tubing hanger 14. The mule shoe profile 122 may drive the mule shoe sub 110 to rotate against the alignment key 112 until the alignment key 112 is set into the alignment slot 130. At this point, the mule shoe sub 110 will be properly oriented relative to the tubing hanger 14 so as to make the desired mating connections at the interface of couplings 118 and 32. As such, rotation of the mule shoe sub 110 stops when the couplings 118 of the mule shoe sub 110 are aligned to the couplings 32 on the tubing hanger 14.

The production stab sub 114 may be mounted to the tree body 18. The mule shoe sub 110 is disposed around an outer circumference of the production stab sub 114. The production stab sub 114 may retain the mule shoe sub 110 thereon while allowing the mule shoe sub 110 rotational freedom about the production stab sub 114. As such, the production stab sub 114 rotationally couples the mule shoe sub 110 to the tree 18. The mule shoe sub 110 is able to rotate relative to the production stab sub 114 and the tree 18 as the tree 18 is being lowered into the wellhead 12.

The coiled hydraulic tubing (116) provides a communication path for hydraulic fluid being communicated from fluid ports in the tree 18 to corresponding fluid ports in the mule shoe sub 110 and ultimately the tubing hanger 14. The coiled arrangement of the hydraulic tubing (116) allows the tubing to flex as the mule shoe sub 110 rotates in either direction to align the couplings 118 with those of the tubing hanger 14 while the tree 18 is being lowered.

The electrical conduits (116) provide a communication path for electrical and/or fiber optic signals being communicated from cables in the tree 18 to corresponding cables in the mule shoe sub 110 and ultimately the tubing hanger 14. The coiled arrangement of the electrical conduits (116) allows the conduit to flex as the mule shoe sub 110 rotates in either direction to align the couplings 118 with those of the tubing hanger 14 while the tree 18 is being lowered.

A general description of a method for operating the tubing hanger alignment device 16 of FIGS. 2 and 3 will now be described. The production stab sub 114 may be installed onto a lower portion of the tree 18. The production stab sub 114 may be coupled to the tree 18 via threads, a lock ring, or any other known method. The production stab sub 114 may be connected to the tree 18 in a manner that does not allow rotation of the production stab sub 114 relative to the tree 18. In other embodiments, the production stab sub 114 may be formed integral with the tree 18.

The method may also include installing the mule shoe sub 110 onto the production stab sub 114. The mule shoe sub 110 may be disposed around the outside circumference of the generally cylindrical production stab sub 114, and the mule shoe sub 110 may be rotatably coupled to the production stab sub 114. The mule shoe sub 110, for example, may be connected to the outside of the production stab sub 114 via a bearing interface that enables free rotation of the mule shoe sub 110 around the production stab sub 114 while these components are lowered through the wellhead 12.

The one or more lengths of hydraulic tubing and/or electrical conduits 116 may be connected between the bottom of the tree body 18 and the top of the mule shoe sub 110. The electrical conduits and/or hydraulic tubing 116 may be coiled around the outer diameter of the production stab sub 114 in a space located longitudinally between the tree 18 and the mule shoe sub 110. In some embodiments, the conduits and/or tubing 116 may be extended upward from the connected cables and/or ports 120 in the mule shoe sub 110, coiled one or more times each around the production stab sub 114, and connected to contacts 132 at a lower end of the tree body 18. In other embodiments, the conduits and/or tubing 116 may be extended from an interface at the lower end of the tree body 18, coiled one or more times each around the production stab sub 114, and connected to cables and/or ports 120 in the mule shoe sub 110 via contacts at an upper end of the mule shoe sub 110.

During assembly of the tubing hanger assembly, the alignment key 112 is installed along an inner diameter of the tubing hanger 14. The alignment key 112 may be installed securely within a recess formed in the tubing hanger 14 along the inner diameter. As shown, the alignment key 112 is disposed in a particular position along the circumference of the inner surface of the tubing hanger 14. The alignment key 112 does not extend about the entire circumference of the inner surface of the tubing hanger 14. The alignment key 112 may be installed via a fastener such as a bolt or screw into the recess of the tubing hanger 14. The alignment key 112 may have a width that is sized to be received into the vertical slot 130 of the mule shoe profile 122 associated with the mule shoe sub 110.

Upon assembly of the above components, the tubing hanger 14 may be run into the wellhead 12 in any orientation, locked into place, and sealed within the wellhead 12. The tree assembly having the tree body 18 and the tubing hanger alignment device 16 (i.e., production stab sub 114, mule shoe sub 110, and coiled tubing/conduits 116) is then run and oriented into a desired location in the wellhead 12 prior to landing within the wellhead 12.

While the tree 18 is landed from an initial position in the wellhead 12 to its final connected position, the mule shoe sub 110 may engage the alignment key 112 so as to orientate the couplings 32 and 118 associated with the tubing hanger 14 and the mule shoe sub 110, respectively. The mule shoe profile 122 on the outer edge of the mule shoe sub 110 may directly engage the alignment key 112 on the tubing hanger 14. Lowering the tree 18 further causes the mule shoe sub 110 to rotate about the production stab sub 114 and align with the tubing hanger 14. That is, the stationary alignment key 112 forces the mule shoe sub 110 to rotate in one direction or the other (depending on the direction of the slope of the mule shoe profile 122 at the point of initial contact with the alignment key 112) as the tree 18 is lowered until the alignment key 112 is received into the alignment slot 130 of the mule shoe profile 122. At this point, the mule shoe sub 110 will be in a proper alignment with the tubing hanger 14.

The tree 18 may then be landed and locked to the wellhead 12. All couplings between the mule shoe sub 110 and the tubing hanger 14 will be engaged at this point. The hydraulic, electric, and/or fiber optic couplings between the tree 18 and the tubing hanger 14 will then be tested to ensure a proper connection has been made.

Figure 3:
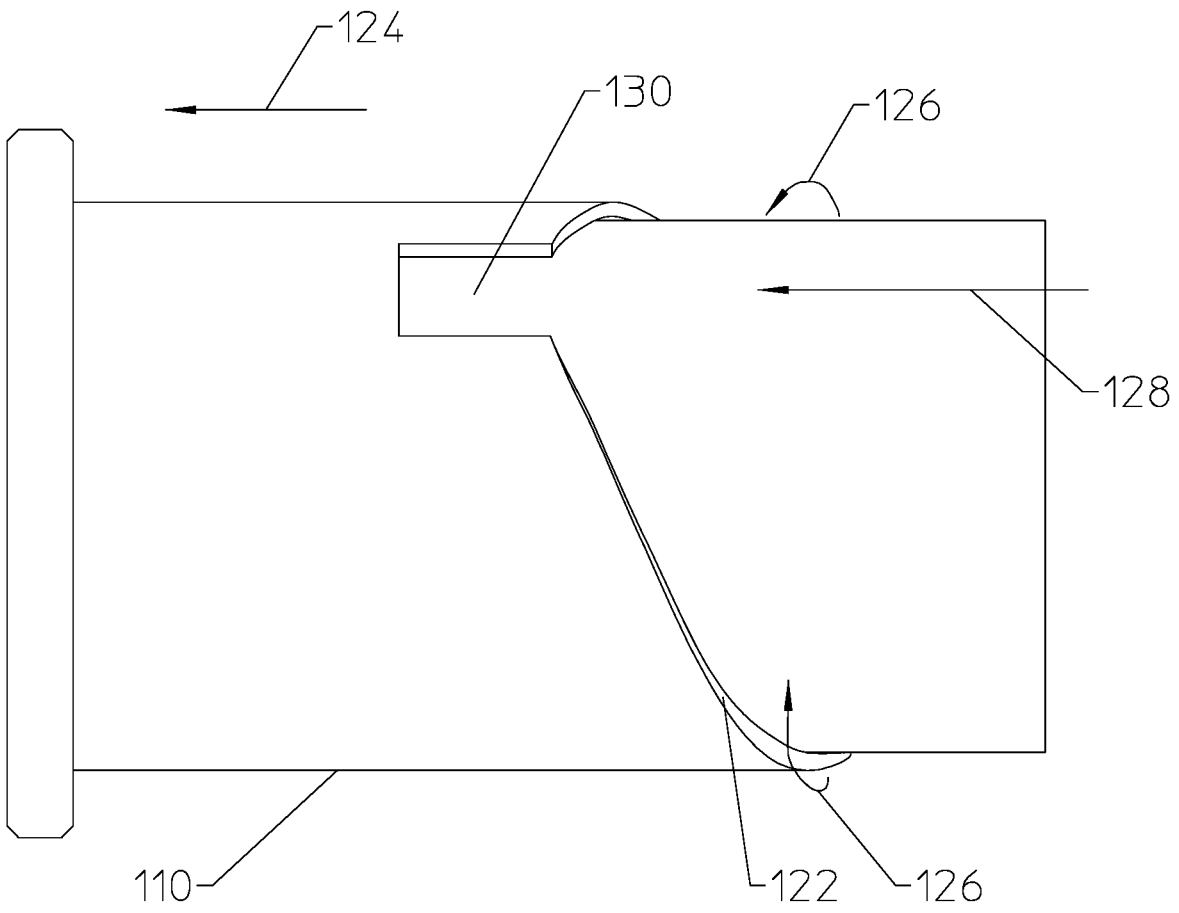
FIG. 3 is a perspective view of a mule shoe sub used in the tubing hanger alignment device of FIG. 2, in accordance with an embodiment of the present disclosure.

The disclosed tubing hanger alignment device 16 of FIGS. 2 and 3 may achieve the goal of aligning the tubing hanger penetrations (i.e., couplings/stabs 32 and 118) independent of the orientation about the longitudinal axis in which the tree 18 is landed. The alignment process is passive and resets without manual intervention subsea or on the surface. Existing vendor seals, hydraulic couplers, and electrical connectors of the tubing hanger 14 may be utilized in implementations of the disclosed alignment device 16. Existing tree body designs may need some modification to remove and replace existing couplers with tubing/conduit connections leading to the tubing/conduits 116. Existing tubing hangers may be utilized with only a minor modification to add the alignment key 112. Existing tubing hanger running tools may be utilized without modification.

Coiled Tubing Alignment Mechanism with Multi-Start Alignment Threads

Another embodiment of a tubing hanger alignment device 16 having a coiled tubing mechanism will be described with reference to FIGS. 4A-8B. The tubing hanger alignment device 16 of FIGS. 4A-8B includes a production stab sub 610, an alignment sub 612, an outer timing ring 614, and one or more lengths of coiled hydraulic tubing and/or electrical and/or fiber optic conduits 616. The arrangement and interaction of these components will now be described.

Figure 9:
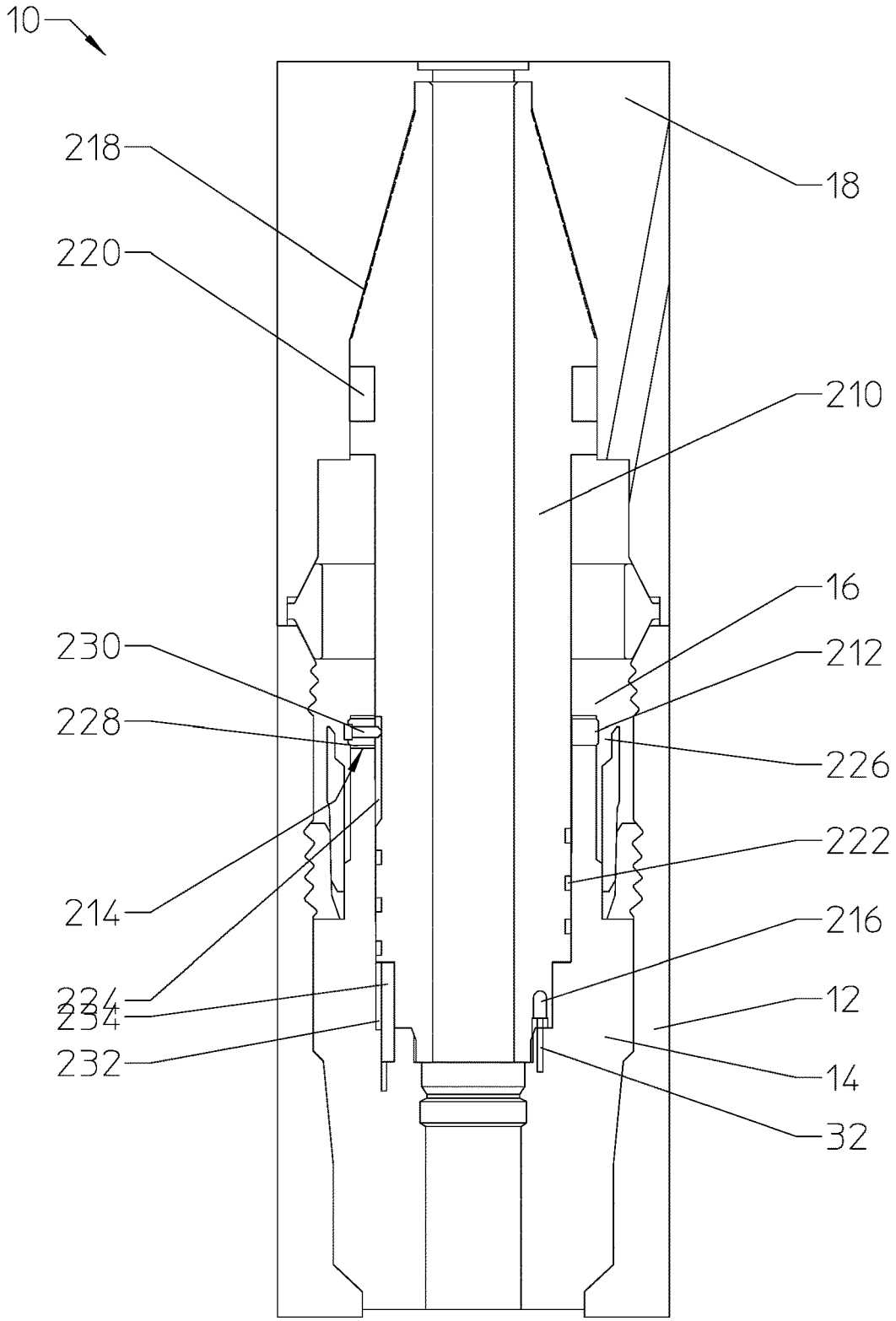
FIG. 9 is a cross-sectional view of a production system comprising a tubing hanger alignment device with a helical slot alignment mechanism, in accordance with an embodiment of the present disclosure.

Similar to the mule shoe sub 110 of FIG. 2 and the alignment body of FIG. 9, the alignment sub 612 may house standard hydraulic, electric, and/or fiber optic couplings 118 that interface with the corresponding couplings/stabs at a top end of the tubing hanger (not shown) upon landing of the tree (not shown). The alignment sub 612 is generally mounted to the production stab sub 610, as shown. In the running position, the alignment sub 612 extends downward to approximately the same ultimate position as that of the production stab sub 610, so that the alignment sub 612 provides a protective barrier between seals 618 at a lower end of the production stab sub 610 and external components.

The alignment sub 612 includes hydraulic fluid ports and/or electrical cables 120 extending therethrough. The ports and/or cables 120 may be connected to or through the coiled hydraulic tubing and/or electrical and/or fiber optic conduits 616 at the top of the alignment sub 612 to allow the alignment sub 612 to rotate relative to the body of the tree. Electrical cables and/or hydraulic ports 120 disposed through the alignment sub 612 may be terminated to a series of electric/fiber contacts and/or hydraulic connectors 118 that interface with the tubing hanger at the bottom of the alignment sub 612.

Similar to the embodiments of FIG. 2 and FIG. 9, the alignment sub 612 is able to rotate relative to the tree body (not shown) and the production stab sub 610. Similar to the embodiment of FIG. 9, this rotation is driven by the outer timing ring 614. As illustrated, an external surface of the alignment sub 612 features a plurality of alignment threads 620 formed therein. These alignment threads 620 are a series of helical shaped slots or grooves formed into the alignment sub 612 and spaced about the circumference of the alignment sub 612. Each alignment thread 620 includes an independent starting point at the bottom thereof, each starting point designed to receive a corresponding pin 622 of the outer timing ring 614. In the illustrated embodiment, the alignment threads 620 include a six-pitch alignment thread, meaning there are six starting points corresponding to six threads. Other numbers of threads are possible in other embodiments as well. The outer timing ring 614 includes a plurality of pins 622, which extend from an internal diameter of the outer timing ring 614 in a radially inner direction and are located in corresponding alignment threads 620 of the alignment sub 612. As such, the outer timing ring 614 generally functions as a nut riding on the threads 620 of the alignment sub 612. At an upper portion of the alignment sub 612, the alignment threads 620 transition into vertical alignment slots 624 located around the circumference of the alignment sub 612.

The outer timing ring 614 includes one or more key features 626 designed to interact with complementary key features of the tubing hanger (not shown). For example, as shown, the outer timing ring 614 may feature lugs 626 extending in a downward direction from a lower surface of the outer timing ring 614. These lugs 626 are designed to interface with corresponding grooves or slots formed in an upward facing surface of the tubing hanger (not shown) to time the start of alignment rotation so that couplings 118 at the bottom of the alignment sub 612 will be aligned with the corresponding couplings/stabs at the top of the tubing hanger. The lugs 626 may include three lugs, four lugs, or some other number of lugs. The lugs 626 on the outer timing ring 614 may be unevenly spaced from each other around the circumference of the outer timing ring 614, unevenly spaced in a radial direction from a longitudinal axis of the outer timing ring, extending different lengths in the longitudinal direction, or a combination thereof. The corresponding grooves or slots extending into the tubing hanger may be arranged in a similar unevenly positioned manner. That way, the lugs 626 of the outer timing ring 614 are received into the corresponding grooves or slots of the tubing hanger only when the outer timing ring 614 is in a particular orientation with respect to the tubing hanger about a longitudinal axis.

It should be noted that, in other embodiments, the key features on the outer timing ring and the tubing hanger may be reversed, such that the outer timing ring includes keyed slots or grooves formed therein to be received on upwardly extending lugs of the tubing hanger.

The outer timing ring 614 seats the tubing hanger alignment device 16 in a desired orientation within the tubing hanger, regardless of how the tubing hanger is oriented within the wellhead. Once the outer timing ring 614 is keyed into the tubing hanger, it cannot be rotated with respect to the tubing hanger. The alignment sub 612 then moves downward, rotating with respect to the stationary outer timing ring 614 until it reaches an aligned position relative to the tubing hanger (not shown) for making the desired fluid, electric, and/or fiber optic connections. At this point, the alignment sub 612 will be properly oriented relative to the tubing hanger so as to make the desired mating connections at the interface of couplings 118 and (32 of FIG. 1). As such, rotation of the alignment sub 612 stops when the couplings 118 of the alignment sub 612 are aligned to the couplings 32 on the tubing hanger.

The production stab sub 610 may be mounted to the tree body (not shown), similar to the production stab sub 114 of FIG. 2. The alignment sub 612 is disposed around an outer circumference of the production stab sub 610. The production stab sub 610 may retain the alignment sub 612 thereon while allowing the alignment sub 612 rotational freedom about the production stab sub 610. As such, the production stab sub 610 rotationally couples the alignment sub 612 to the tree. The alignment sub 612 is able to rotate relative to the production stab sub 610 and the tree as the tree is lowered onto the wellhead.

The alignment sub 612 may be equipped with an actuation mechanism 628 used to release the production stab sub 610 from the alignment sub 612 so that the production stab sub 610 can move in a longitudinal direction with respect to the alignment sub 612. The actuation mechanism 628 is designed so that it can only be activated once the alignment sub 612 is in an aligned position with respect to the tubing hanger. In the illustrated embodiment, the actuation mechanism 628 includes one or more actuation buttons 630 and a split ring 632. The split ring 632 is held in position within a circumferential groove formed along a radially inner diameter of the alignment sub 612. The split ring 632 is biased in a radially outward direction so that it retains the alignment sub 612 at a particular longitudinal position relative to the production stab sub 610. Although not shown, the split ring 632 may be coupled to the production stab sub 610 via a shoulder or some other attachment feature. The actuation buttons 630 may extend from a radially outer diameter of the alignment sub 612 to the radially inner diameter of the alignment sub 612 where the split ring 632 is retained. A force applied in a radially inward direction to the one or more buttons 630 presses the buttons 630 into the split ring 632, thereby collapsing the split ring 632 so that the alignment sub 612 is no longer held in a fixed longitudinal position with respect to the production stab sub 610. This enables the production stab sub 610 to move further downward so that the seals 618 at the bottom thereof can be extended to interface with the tubing hanger.

While in the retracted position, gallery seals are not energized, allowing for free rotation of the alignment sub 612 around the production stab sub 610. Once the gallery seals are engaged, they will prevent further rotation such that the tree can be removed and reinstalled in the same orientation.

The coiled hydraulic tubing (616) provides a communication path for hydraulic fluid being communicated from fluid ports in the tree to corresponding fluid ports in the alignment sub 610 and ultimately the tubing hanger. The coiled arrangement of the hydraulic tubing (616) allows the tubing to flex as the alignment sub 612 rotates to align the couplings 118 with those of the tubing hanger while the tree is being lowered.

The electrical conduits (616) provide a communication path for electrical and/or fiber optic signals being communicated from cables in the tree to corresponding cables in the alignment sub 612 and ultimately the tubing hanger. The coiled arrangement of the electrical conduits (616) allows the conduit to flex as the alignment sub 612 rotates to align the couplings 118 with those of the tubing hanger while the tree is being lowered.

Figure 4A:
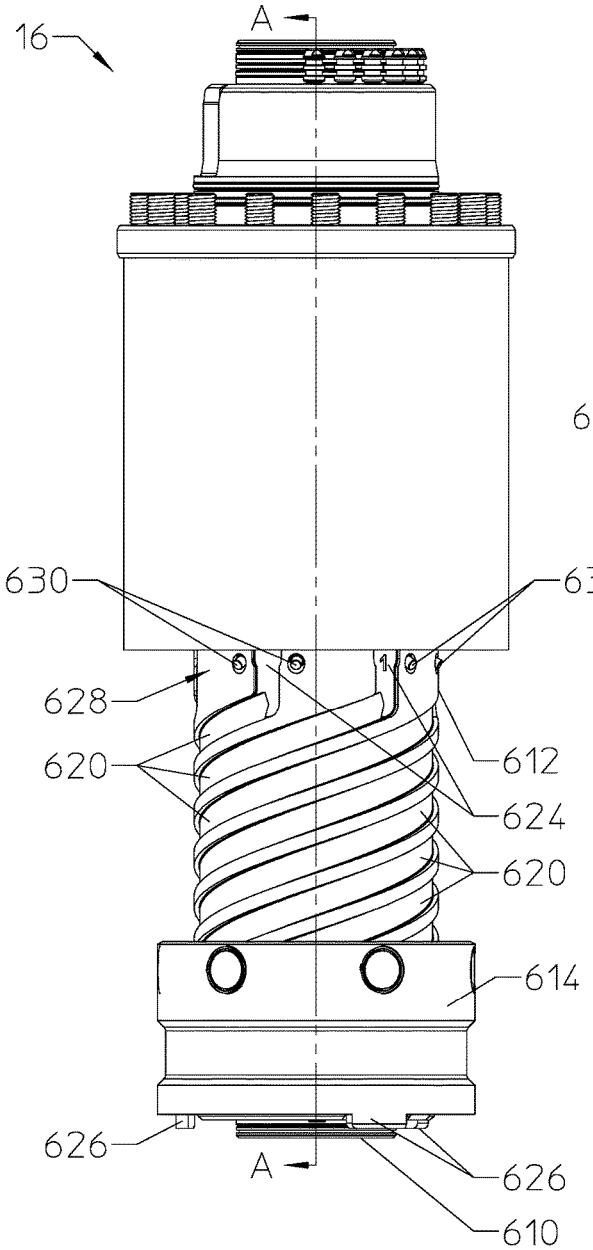
FIGS. 4A and 4B are a perspective view and a cross-sectional view, respectively, of a tubing hanger alignment device in a running configuration with a coiled tubing alignment mechanism, in accordance with an embodiment of the present disclosure.
Figure 4B:
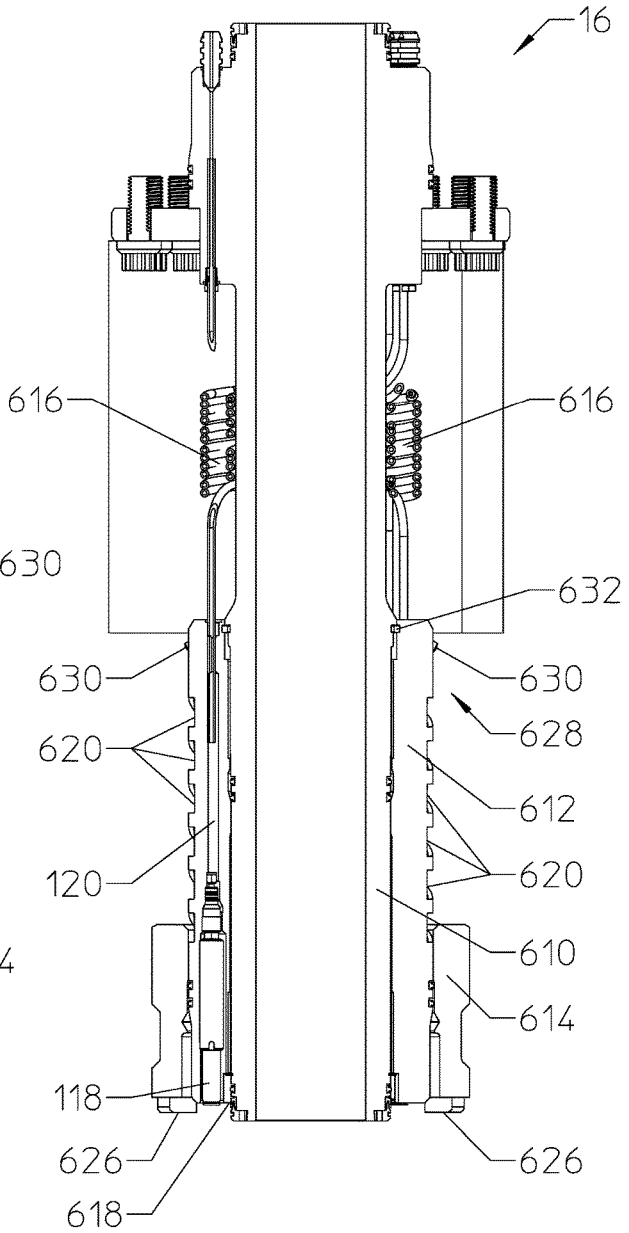

A general description of a method for operating the tubing hanger alignment device 16 of FIGS. 4A-8B will now be provided. FIGS. 4A and 4B show the tubing hanger alignment device 16 in a running configuration. This is the configuration of the tubing hanger alignment device 16 during the initial stage of lowering the tubing hanger alignment device 16 with the tree toward the wellhead. In this configuration, the outer timing ring 614 is located at the lower end of the alignment sub 612, with the pins 622 positioned in their corresponding alignment threads 620 where the threads begin. The components of the tubing hanger alignment device 16 remain in this position until the tubing hanger alignment device 16 is positioned in the wellhead just above the tubing hanger. Once the tubing hanger alignment device 16 is lowered far enough that the outer timing ring 614 contacts the tubing hanger in the wellhead, the outer timing ring 614, the alignment sub 612, or both, may rotate relative to the tree until the key features 626 (e.g., lugs) at the bottom of the outer timing ring 614 are received into the corresponding features (e.g., grooves or slots) of the tubing hanger.

Figure 5A:
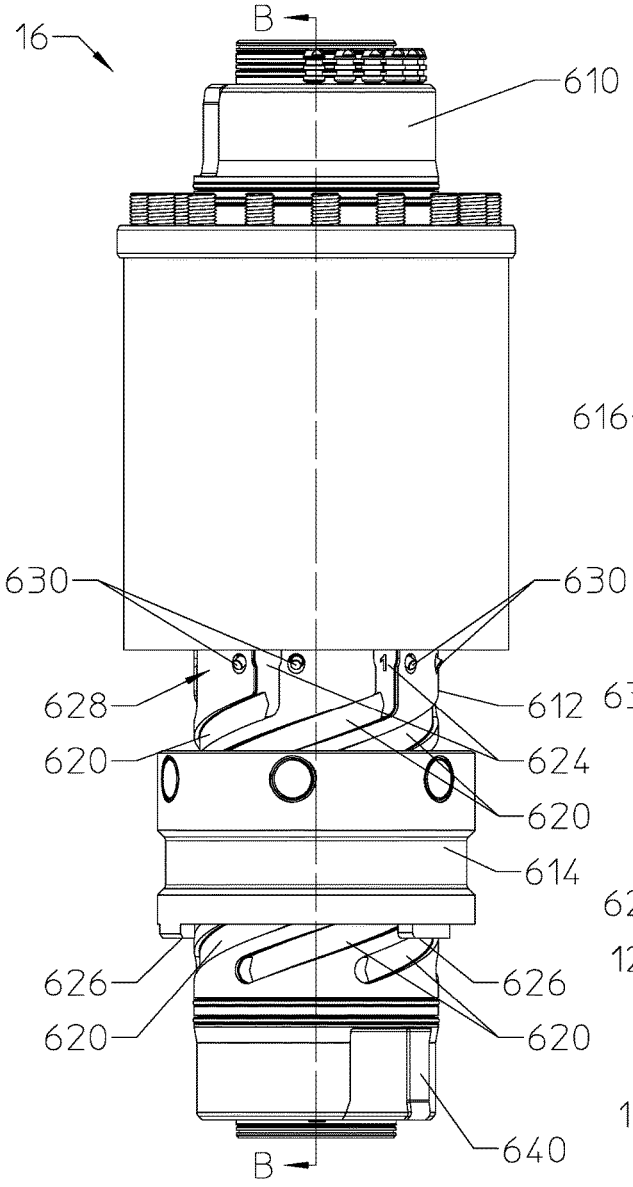
FIGS. 5A and 5B are a perspective view and a cross-sectional view, respectively, of the tubing hanger alignment device of FIGS. 4A and 4B in an aligning configuration, in accordance with an embodiment of the present disclosure.
Figure 5B:
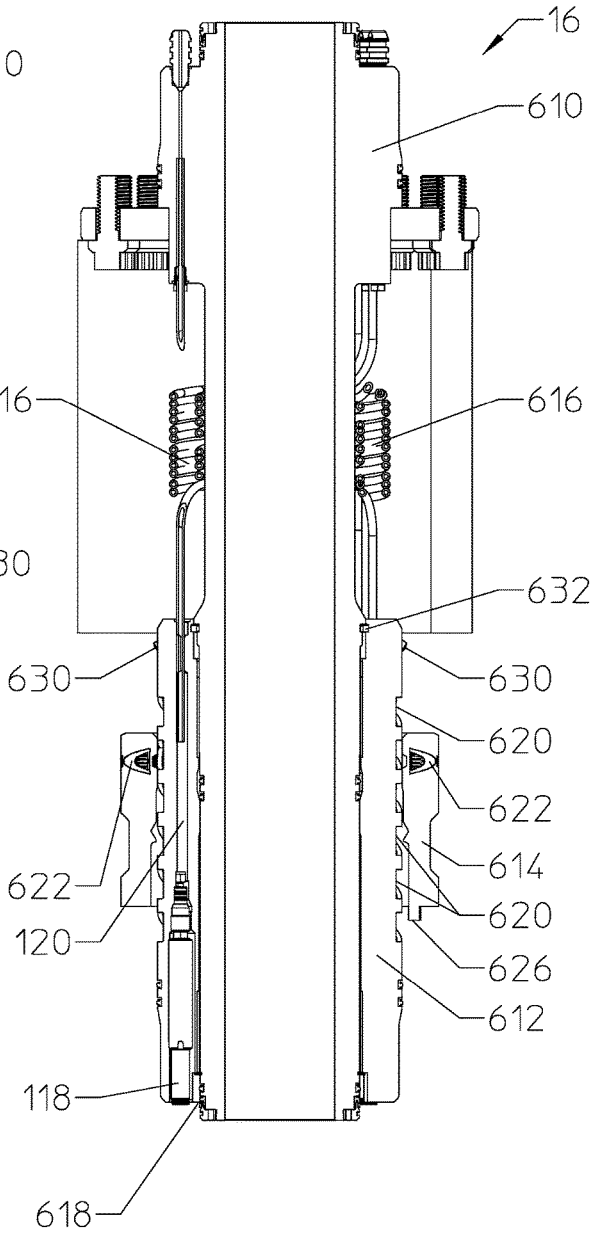

Once the outer timing ring 614 is firmly seated within the tubing hanger, further downward force applied to the tree causes the alignment sub 612 to rotate relative to the outer timing ring 614 and the tubing hanger. This is illustrated in FIGS. 5A and 5B. The tree and production stab sub 610 are being lowered relative to the tubing hanger and the outer timing ring 614, while the outer timing ring 614 is held stationary within the tubing hanger. With its pins 622 engaged in the alignment threads 620 of the alignment sub 612, the outer timing ring 614 drives the alignment sub 612 to rotate toward an aligned position relative to the tubing hanger where the hydraulic, electric, and/or fiber optic couplings 118 of the alignment sub 612 are aligned with those of the tubing hanger. As this is happening, the coiled tubing 616 flexes to maintain the connections between the tree and the alignment sub 612 while the alignment sub 612 rotates relative to the tree.

Figure 6A:
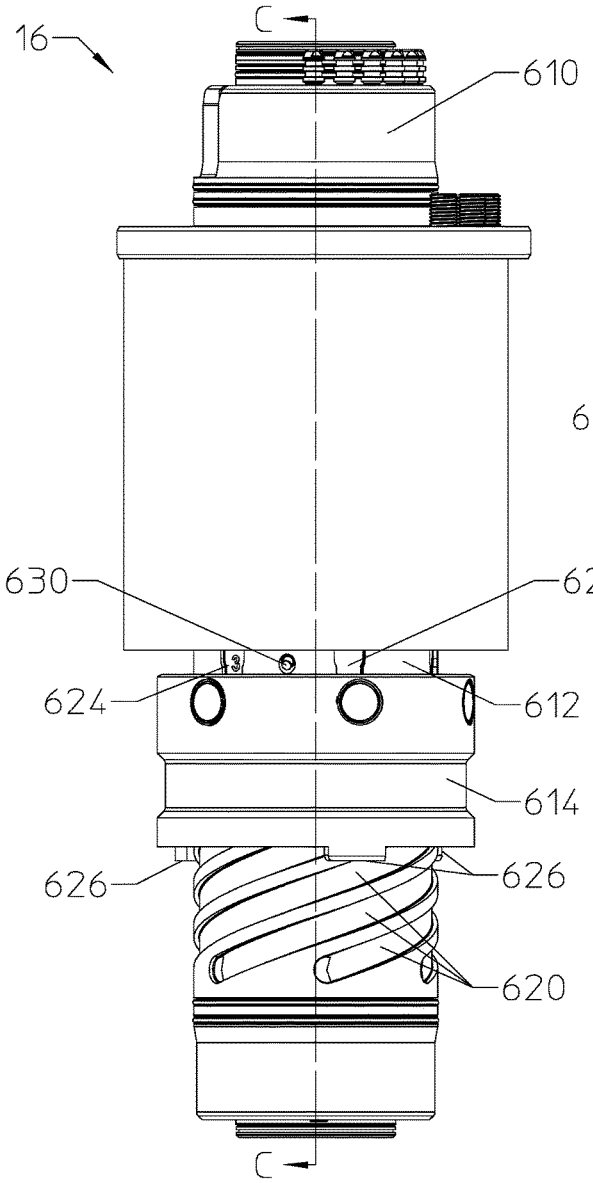
FIGS. 6A and 6B are a perspective view and a cross-sectional view, respectively, of the tubing hanger alignment device of FIGS. 4A-5B in an aligned configuration, in accordance with an embodiment of the present disclosure.
Figure 6B:
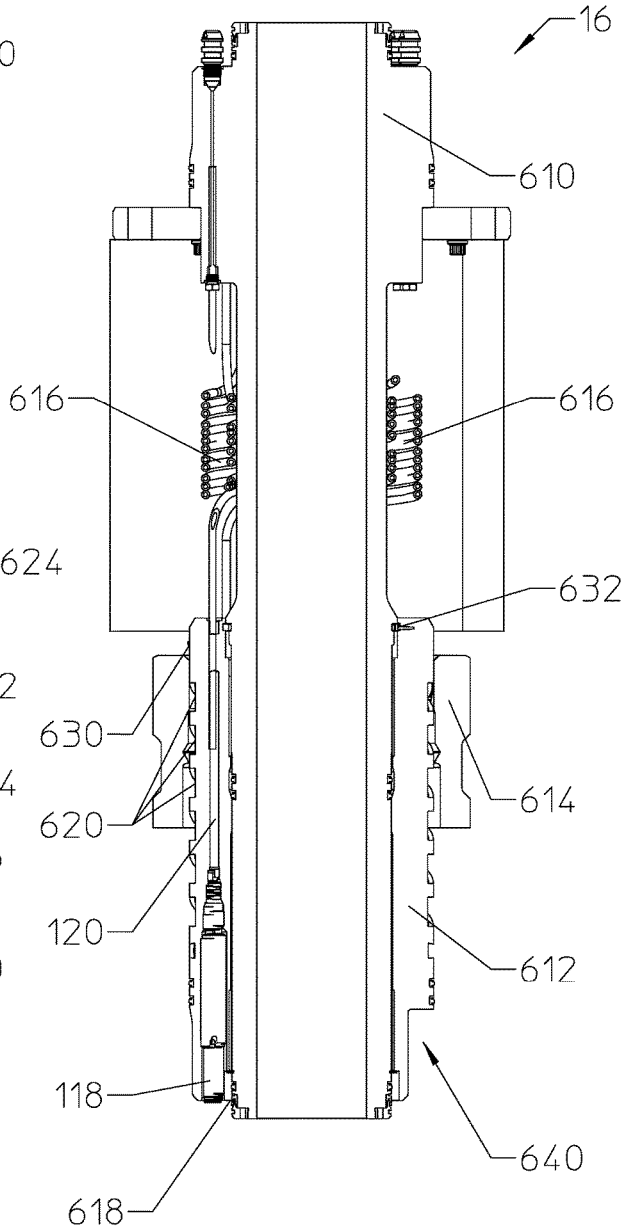
Figure 7A:
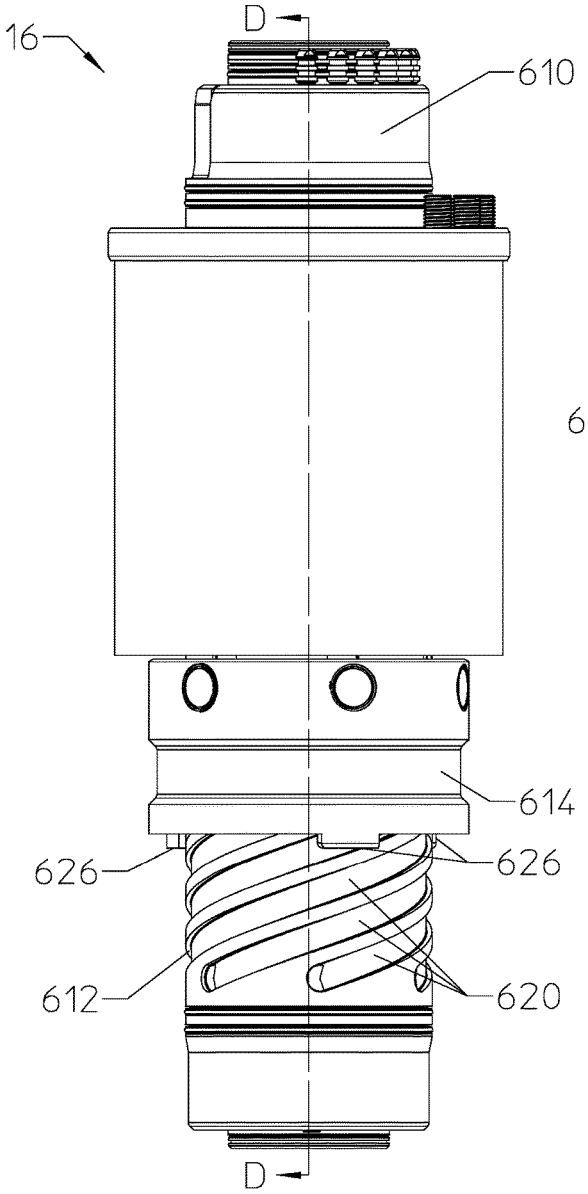
FIGS. 7A and 7B are a perspective view and a cross-sectional view, respectively, of the tubing hanger alignment device of FIGS. 4A-6B in a configuration with the lower body released, in accordance with an embodiment of the present disclosure.
Figure 7B:
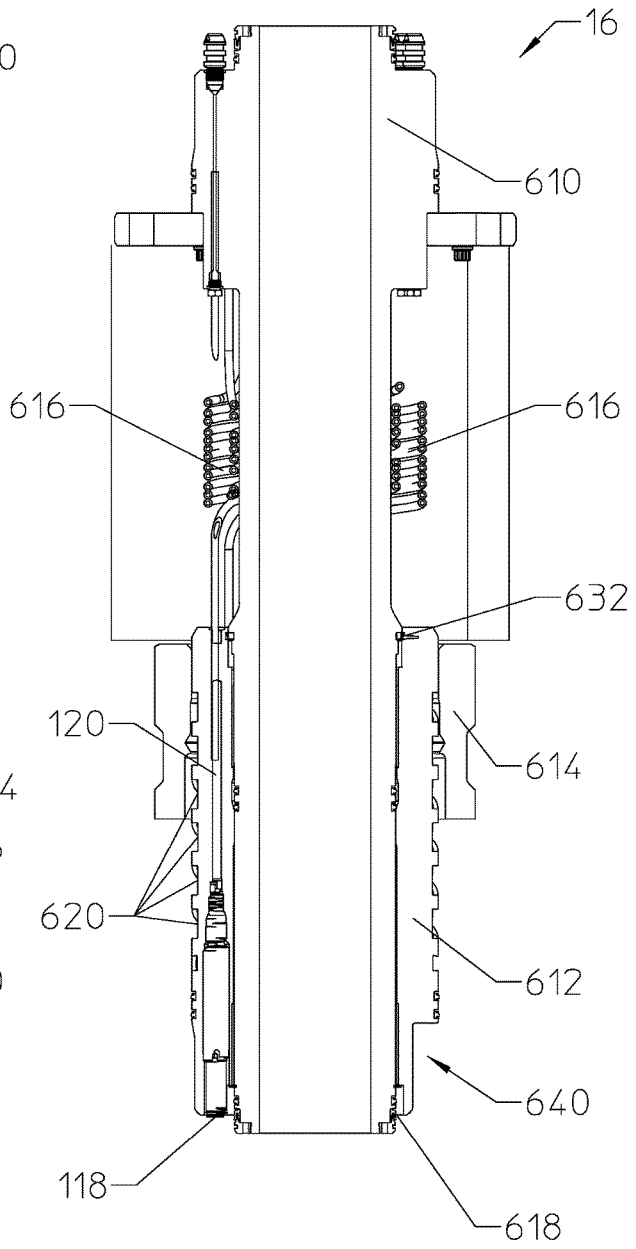

When the outer timing ring 614 reaches the top of the alignment threads 620, the alignment sub 612 and its couplings 118 will be rotationally aligned with the connectors of the tubing hanger, and the pins 622 of the outer timing ring 614 will enter the vertical alignment slots 624. This aligned configuration is shown in FIGS. 6A and 6B. From here, further downward force on the tree and tubing hanger alignment device 16 will cause the alignment sub 612, the production stab sub 610, and the tree to move vertically downward relative to the outer timing ring 614 and the tubing hanger. This position is shown in FIGS. 7A and 7B. In this position, the couplings 118 of the alignment sub 612 are just above the corresponding connectors of the tubing hanger, and the outer timing ring 614 is in a position where it is covering/depressing the actuation buttons 630 at the top of the alignment sub 612. These actuation buttons 630, once depressed, push the split ring 632 radially inward to release the production stab sub 610 so that it can travel longitudinally with respect to the alignment sub 612.

In some embodiments, the alignment sub 612 may be equipped with a final/fine alignment socket 640, and the tubing hanger may be equipped with a corresponding final/fine alignment key. The layout and description of these final/fine alignment features is discussed at length below with reference to final alignment key 232 and final alignment slot 234 of FIG. 9. Similar final/fine alignment features (e.g., alignment slot 640 and a corresponding key on the tubing hanger) may be implemented in the embodiment of FIGS. 4A-8B as well. The final alignment would be made via the alignment slot 640 and corresponding key while the alignment sub 612 is moving vertically downward relative to the outer timing ring 614 engaged with the vertical alignment slots 624.

Figure 8A:
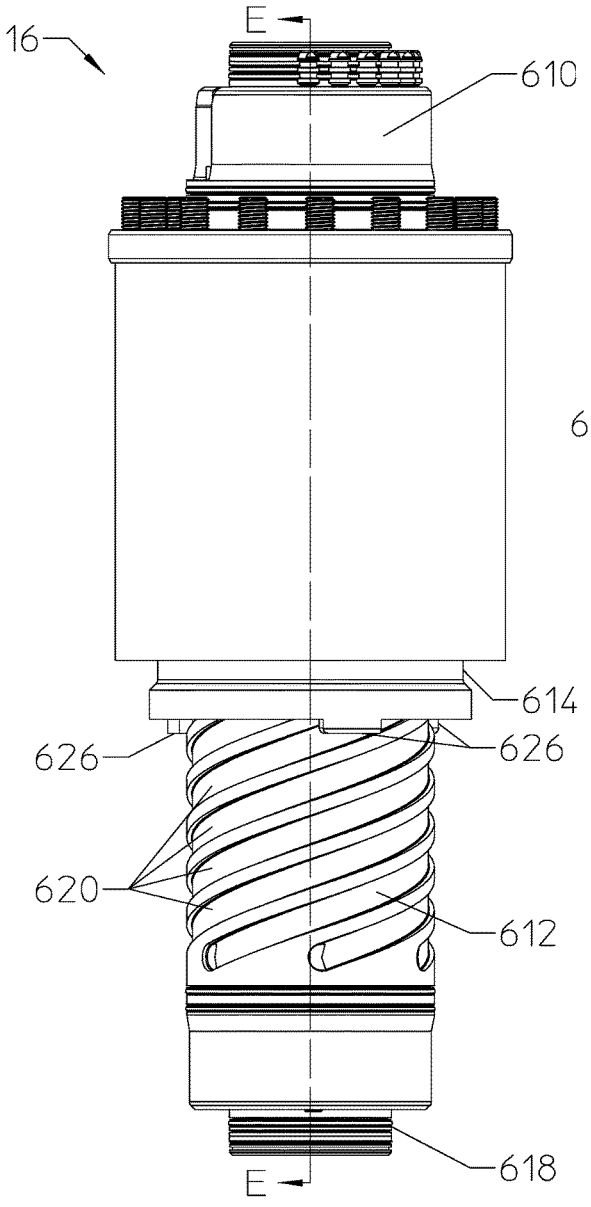
FIGS. 8A and 8B are a perspective view and a cross-sectional view, respectively, of the tubing hanger alignment device of FIGS. 4A-7B in a landed configuration, in accordance with an embodiment of the present disclosure.
Figure 8B:
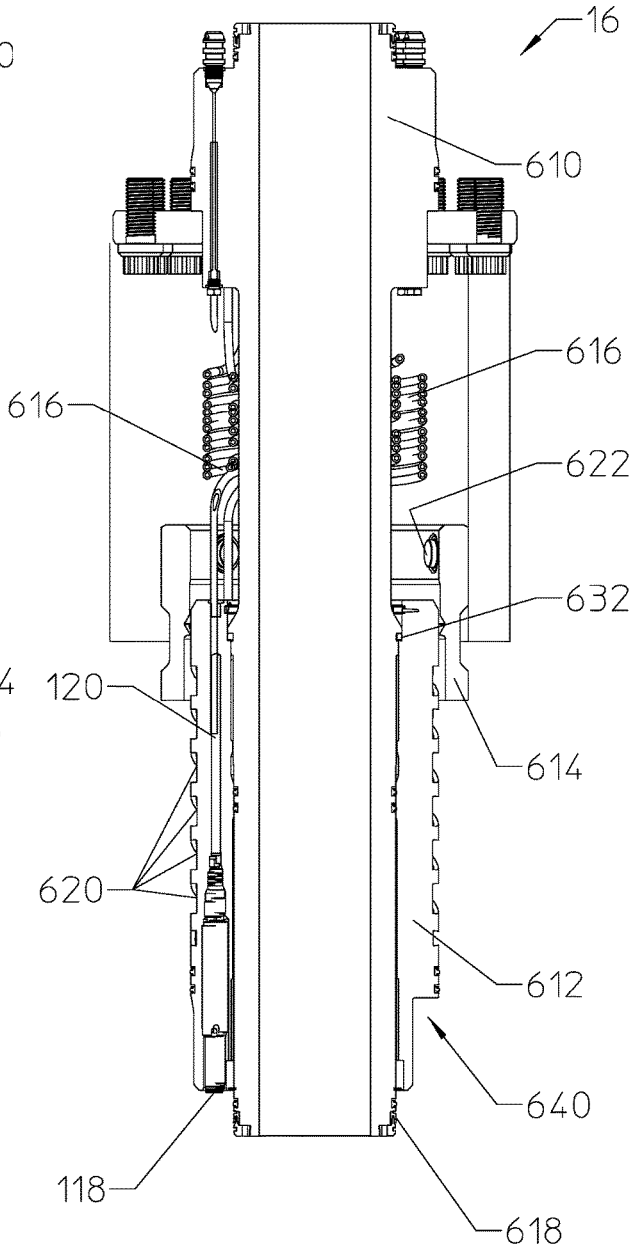

At this point, further lowering of the tree causes the production stab sub 610 to move downward relative to the alignment sub 612, uncovering the seals 618 at the lower end thereof and engaging gallery seals. The production stab sub 610 will move downward, stabbing into the tubing hanger and activating the seals 618 against the tubing hanger interface. The alignment sub 612 may also be lowered a certain amount to complete the stabbing connections between the couplings 118 and the corresponding connectors of the tubing hanger. This brings the tubing hanger alignment device 16 to the fully landed position within the wellhead, as shown in FIGS. 8A and 8B.

The tubing hanger alignment device 16 of FIGS. 4A-8B is similar to the embodiment of the tubing hanger alignment device 16 of FIGS. 2 and 3, except for the addition of the outer timing ring 614 used to rotate the alignment sub 612 and to actuate the split ring 632, enabling downward movement of the production stab sub 610 relative to the alignment sub 612. This arrangement, which allows for the downward movement of the production stab sub 610 relative to the alignment sub 612, facilitates protection of the seals 618 at the bottom of the production stab sub 610 during initial lowering of the system through the wellhead.

The disclosed tubing hanger alignment device 16 of FIGS. 4A-8B may achieve the goal of aligning the tubing hanger penetrations (i.e., couplings/stabs 32 and 118) independent of the orientation about the longitudinal axis in which the tree 18 is landed. The alignment process is passive. Existing vendor seals, hydraulic couplers, and electrical connectors of the tubing hanger 14 may be utilized in implementations of the disclosed alignment device 16. Existing tree body designs may need some modification to remove and replace existing couplers with tubing/conduit connections leading to the tubing/conduits 616. Existing tubing hangers may be utilized with only a minor modification to add the keyed features for interfacing with the outer timing ring 614. Existing tubing hanger running tools may be utilized without modification Helical Slot Alignment Mechanism A tubing hanger alignment device 16 having a helical slot mechanism will be described with reference to FIGS. 9 and 10. The tubing hanger alignment device 16 of FIG. 9 includes an alignment body 210, a timing ring 212, and a timing hub 214. The arrangement and interaction of these components will now be described.

The alignment body 210 may be a single, solid piece that houses standard type (or actuated type) hydraulic, electric, and/or fiber optic couplings 216 that interface with the corresponding couplings/stabs 32 at a top end of the tubing hanger 14. In this embodiment, the alignment body 210 may function as the production stab sub that is coupled directly to the tree body 18. In other embodiments, however, a separate annular production stab sub captured within the alignment body 210 may be used.

The alignment body 210 may include a hydraulic port (not shown) extending therethrough and routed to a hydraulic gallery 218. The hydraulic gallery 218 is open to and in fluid communication with a hydraulic port (not shown) formed through the tree 18 as well. The hydraulic gallery 218 is located in an annular space between the tree body 18 and the alignment body 210, and the hydraulic gallery 218 extends entirely around the circumference of the alignment body 210. The hydraulic gallery 218 allows for rotation of the alignment body 210 relative to the tree 18 while maintaining fluid communication between the hydraulic port in the tree body 18 and the hydraulic port in the alignment body 210.

The alignment body 210 may include electric and/or fiber optic cables (not shown) extending therethrough and routed to an electrical/fiber optic gallery 220. The electric and/or fiber optic cables may be coiled in the electrical/fiber optic gallery 220 between the alignment body 210 and the tree 18. The electric and/or fiber optic cables may extend from the alignment body 210, through the gallery 220, and into the tree body 18. Containing the electric and/or fiber optic cables in a coiled arrangement within the gallery 220 may enable the alignment body 210 to rotate relative to the tree body 18 since the cables are able to flex in response to such movements of the alignment body 210. The cables located within the alignment body 210 may terminate at a series of dry mate electric contacts (couplings 216) on a lower end of the alignment body 210 designed to rotate relative to the tree 18.

The alignment body 210 includes one or more helical slots 222 formed along an outer surface thereof. The helical slot 222 can be seen more clearly in the illustration of FIG. 10. The helical slot 222 drives the alignment body 210 to rotate relative to the tree body 18 as it is lowered with the tree 18. Rotation of the alignment body 210 may stop when the hydraulic, electric, and/or fiber optic couplings 216 are aligned to the couplings/stabs 32 on the tubing hanger 14. The one or more helical slots 222 may each have a straight portion 224 at one end to allow for a non-rotating landing of the alignment body couplings 216 onto the tubing hanger couplings/stabs 32.

The timing hub 214 is coupled to the tubing hanger 14, as shown. The timing hub 214 may be directly coupled to the tubing hanger 14 via an attachment mechanism such as a bolt or screw. The timing hub 214 may include specific keying features 226 formed on an upwardly facing surface thereof. These keying features 226 on the timing hub 214 are designed to capture the timing ring 212 when the ring 212 is clocked to a unique position and orientation relative to the tubing hanger 14. The keying features 226 on the timing hub 214 may include slots or holes formed on the upper face of the timing hub 214. The timing ring 212 may include complementary keying features 228 designed to be received directly into the timing hub 214. The illustrated timing hub 214 includes timed slots machined on the upper face thereof. These slots (226) are positioned such that only one clocked alignment is possible between the timing ring 212 and the timing hub 214. That is, the timing ring 212 will not lock into the timing hub 214 via engagement by the keying features 226 until the timing ring 212 has rotated to a position relative to the timing hub 214 where the features 228 of the timing ring 212 are received into engagement with the corresponding keying features 226 of the timing hub 214.

The timing ring 212 may be attached to the alignment body 210 via one or more alignment pins 230 that land in corresponding helical slots 222 of the alignment body 210. As mentioned above, the timing ring 212 may include uniquely clocked features 228 that interface with the upper face of the timing hub 214. During lowering of the tree 18 (along with the attached alignment body 210 and timing ring 212), the timing ring 212 may land on the timing hub 214. Once landed, continued lowering of the tree body 18 into the wellhead 12 causes the timing ring 212 to rotate until it is stopped by the timing hub 214 and received into mating engagement with the keying features 226 of the timing hub 214. Once the timing ring 212 has been stopped in the timing hub 214, continued lowering of the tree 18 may cause the alignment body 210 to rotate relative to the tree 18 via movement of the alignment pin 230 along the helical slot 222 of the alignment body 210. This rotation will continue until the couplings 216 of the alignment body 210 are aligned with the couplings 32 on the tubing hanger 14.

Once aligned in this manner, the alignment pin(s) 230 coupled to the timing ring 212 may move out of the helical slot 222 and into the straight vertical portion 224. In some embodiments, the alignment body 210 may engage with the tubing hanger 14 via a final alignment key 232 received in a final alignment slot 234. The final alignment slot 234 may be formed in the alignment body 210, and the final alignment key 232 may extend vertically from an engagement surface of the tubing hanger 14. In other embodiments, this arrangement may be reversed, such that the final alignment key extends from the alignment body 210 so as to be received into a final alignment slot formed in the tubing hanger 14. The final alignment key 232 and slot 234 may provide protection to the couplers 216 and 32 and increase machining tolerances of the helical slot 222, the vertical portion of the slot 224, the alignment pins 230, and the keying features of the timing ring 212 and hub 214.

A general description of a method for operating the tubing hanger alignment device 16 of FIGS. 9 and 10 will now be described. The alignment body 210 may be installed into a lower portion of the tree 18, similar to the way a production stab sub is installed in a traditional tree. The timing ring 212 may be installed onto the alignment body 210. Specifically, the timing ring 212 may be disposed around an outer circumference of the alignment body 210, and the alignment pin(s) 230 may be attached directly to the timing ring 212 and extended into the helical slot 222 formed in the alignment body 210.

During construction of the tubing hanger assembly, the timing hub 214 may be installed onto the tubing hanger 14. Specifically, the timing hub 214 may be connected to an upwardly extending portion of the tubing hanger 14 so as to provide a place for seating the timing ring 212 as the tree 18 and alignment body 210 are lowered relative to the tubing hanger 14. The tubing hanger 14 with the connected timing hub 214 may be run in any orientation relative to the wellhead 12 and locked into place within the wellhead 12.

During landing of the tree 18 on the wellhead 12, the timing ring 212 on the alignment body 210 may first land on the timing hub 214. Depending on the initial orientation of the alignment body 210 relative to the tubing hanger 14 and timing hub 214, the timing ring 212 may or may not land directly into a locked position within the timing hub 214. Assuming the timing ring 212 is not in full engagement with the keying features 226 of the timing hub 214 at first, further lowering of the tree 18 may cause the timing ring 212 to rotate relative to the alignment body 210. This rotation of the timing ring 212 relative to the alignment body 310 may be guided by the alignment pin 230 in the helical slot 222. After some rotation, the timing ring 212 may be properly oriented to drop into the slots or other features on the timing hub 214. After dropping into the features on the timing hub 214, the timing ring 212 can no longer rotate with respect to the timing hub 214 and tubing hanger 14.

Lowering the tree 18 further may now cause the alignment body 210 to rotate relative to the tree 18, guided by the helical slot 230 interacting with the stationary alignment pin 222 extending from the timing ring 212. This guiding of the alignment body via the clocked timing ring 212 will cause the alignment body 210 to rotate and align with the tubing hanger 14. Once the alignment body 210 is properly aligned with the tubing hanger 14, the final alignment key 232 may be received into the final alignment slot 234 to finalize the rotational alignment of the couplers 216 on the alignment body 210 to those on the tubing hanger 14.

The tree 18 and alignment body 210 may then be landed and locked to the wellhead 12. All couplings between the alignment body 210 and the tubing hanger 14 will be engaged at this point. The hydraulic, electric, and/or fiber optic couplings between the tree 18 and the tubing hanger 14 will then be tested to ensure a proper connection has been made.

Figure 10:
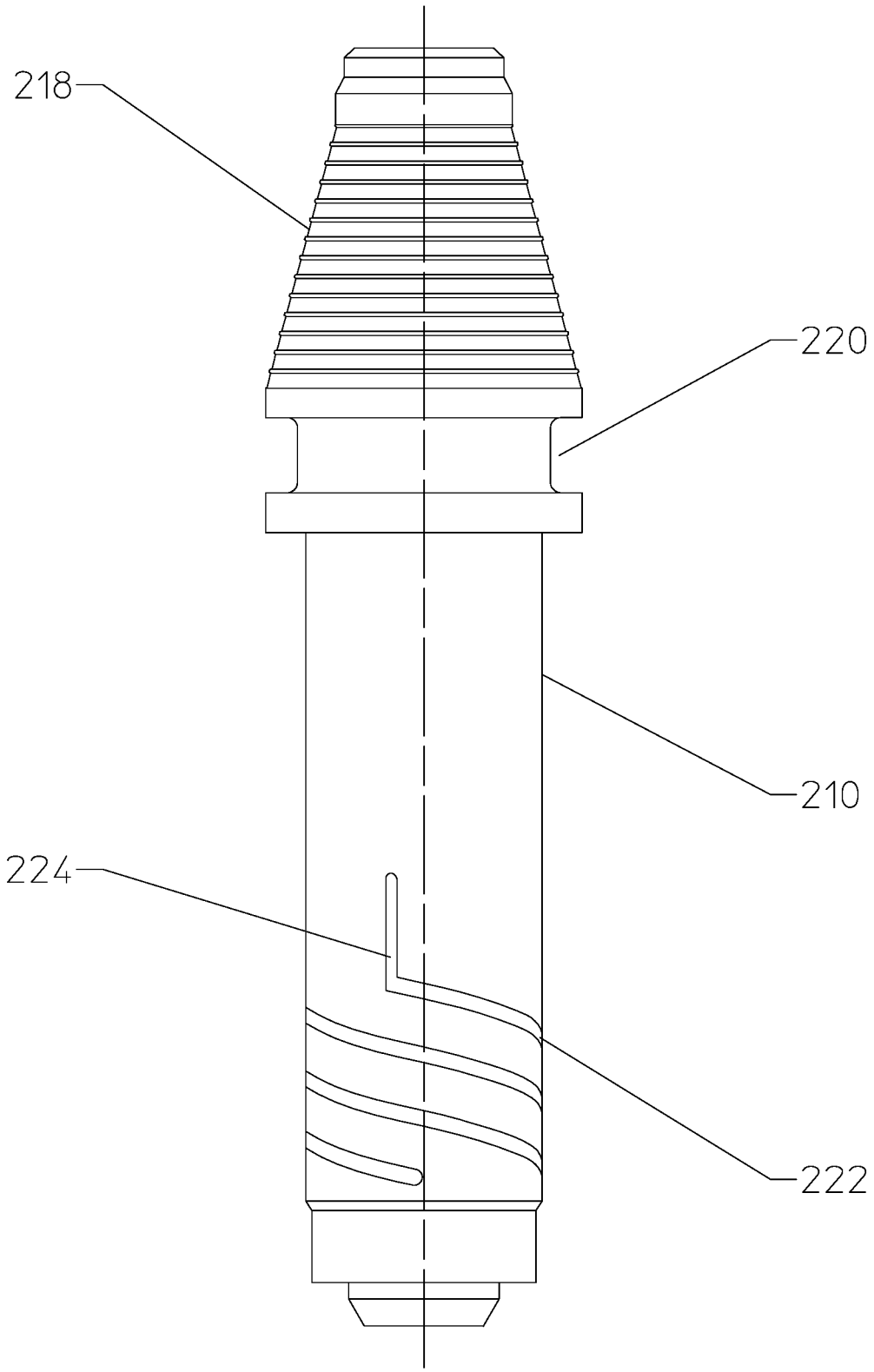
FIG. 10 is a side view of an alignment body used in the tubing hanger alignment device of FIG. 9, in accordance with an embodiment of the present disclosure.

The disclosed tubing hanger alignment device 16 of FIGS. 9 and 10 may achieve the goal of aligning the tubing hanger penetrations (i.e., couplings/stabs 32 and 216) independent of the orientation about the longitudinal axis in which the tree 18 is landed. The alignment process is passive and resets without manual intervention subsea or on the surface. Existing vendor seals, hydraulic couplers, and electrical connectors of the tubing hanger 14 may be utilized in implementations of the disclosed alignment device 16. Existing tree body designs may need some modification to add a gallery seal for the alignment body 210 and/or production stab integration into the lower tree body. Existing tubing hangers may be utilized with only a minor modification to the actuator trap plate. Existing tubing hanger running tools may be utilized without modification.

Torsional Spring Alignment Mechanism

A tubing hanger alignment device 16 having a torsional spring mechanism will be described with reference to FIGS. 11 and 12. The tubing hanger alignment device 16 of FIGS. 11 and 12 includes an upper body 310, a lower body 312, a torsional spring 314, and a trigger assembly 316. The arrangement and interaction of these components will now be described.

The upper body 310 may be a solid piece that houses standard hydraulic, electric, and/or fiber optic couplings 318 that interface with the bottom of the tree 18 to connect hydraulic ports and/or cables in the tree 18 to those in the upper body 310. In this embodiment, the upper body 310 may function as a production stab sub that is coupled directly to the tree body 18. The lower body 312 may be generally disposed around an outer diameter of the upper body 310, as shown. The lower body 312 may be locked in a particular rotational orientation with respect to the upper body 310 prior to release of the lower body 312 via the trigger assembly 316.

The upper body 310 may include one or more hydraulic ports 320 extending therethrough and routed to a hydraulic gallery 322. The hydraulic gallery 322 is open to and in fluid communication with one or more hydraulic ports 324 formed through the lower body 312 as well. The hydraulic gallery 322 may be located in an annular space located between the upper body 310 and the lower body 312, or the hydraulic gallery 322 may be located entirely within the lower body 312 as shown. The hydraulic gallery 322 may extend entirely around the circumference of the upper body 310. The hydraulic gallery 322 allows for rotation of the lower body 312 relative to the upper body 310 while maintaining fluid communication from the between the hydraulic port 320 in the upper body 310 and the hydraulic port 324 in the lower body 312.

The electric couplings (318) may be wired through the upper body 310 to a series of dry mate electric contacts (not shown) that sit between the upper body 310 and the lower body 312. These electric contacts may allow rotation of the lower body 312 with respect to the upper body 310. The upper body 310 may be mounted directly to the tree 18 (e.g., via threads, bolts, or other attachment features) such that the upper body 310 is not rotatable with respect to the tree body 18. As shown in FIG. 12, the upper body 310 may house at least a portion of the trigger assembly 316.

The torsional spring 314 is disposed in an annular space between the upper body 310 and the lower body 312. The torsional spring 314 may be wound during assembly of the tubing hanger alignment device 16 and locked into place via the trigger assembly 316. The torsional spring 314 may be released from its wound position at a desired time in response to actuation by the trigger assembly 316. Such release of the torsional spring 314 may cause the lower body 312 to rotate with respect to the upper body 310.

Figure 12:
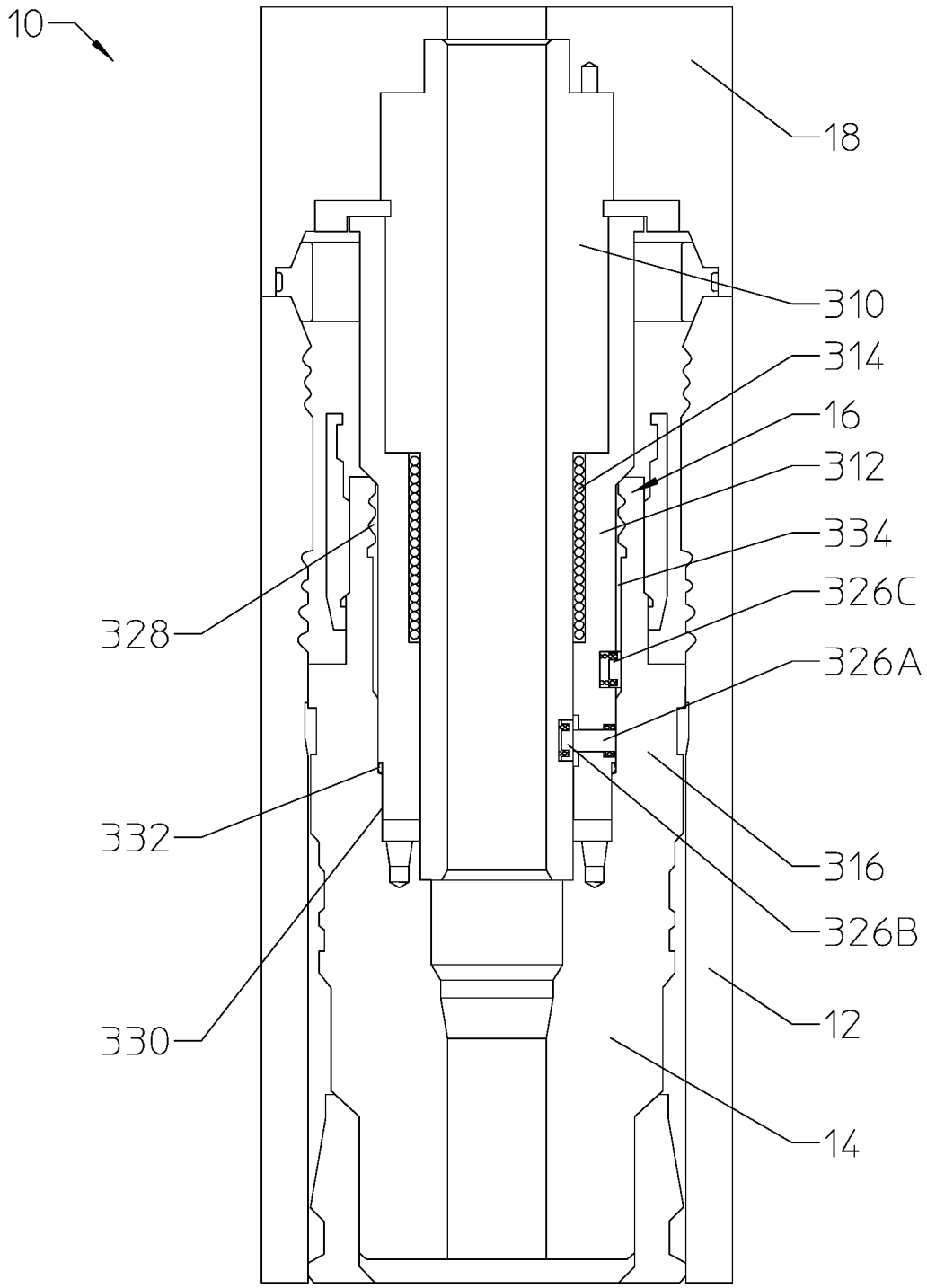
FIG. 12 is another cross-sectional view of the production system of FIG. 11, taken along a different cross section, in accordance with an embodiment of the present disclosure.
Figure 13:
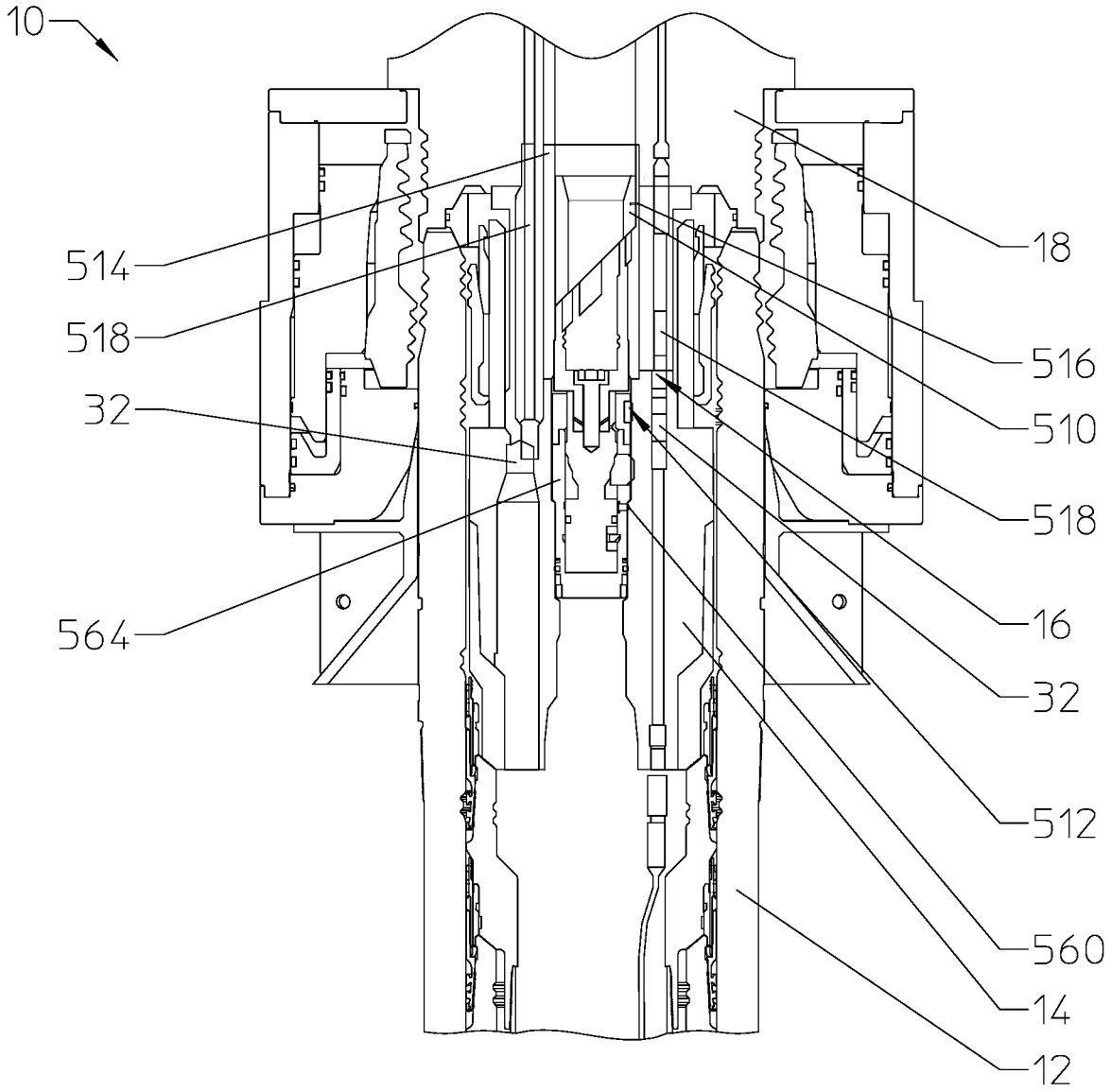
FIG. 13 is a partial cross-sectional view of a production system comprising a tubing hanger alignment device with a plug-based alignment mechanism, in accordance with an embodiment of the present disclosure.

As shown in FIG. 12, the trigger assembly 316 may include a series of spring loaded keys 326A, 326B, and 326C. It should be noted, however, that other possible arrangements of the trigger assembly 316 may be utilized in other embodiments.

The first pair of spring loaded keys 326A and 326B may together function as a trigger for releasing the torsional spring 314 to rotate the lower body 312 once tripped out to a specific elevation within the tubing hanger 14. The spring loaded key 326A may function as a trip key for the trigger assembly 316. This trip key 326A may be attached to the lower body 312 and biased in a radially outward direction. Before actuation of the trigger assembly 316, the trip key 326A may extend at least partially outward from the outer diameter of the lower body 312.

The spring loaded key 326B may function as a retention key for the triggering mechanism 316. This retention key 326B may be attached to the upper body 310 and biased in a radially outward direction. Before actuation of the trigger assembly 316, the retention key 326B may extend outward from the outer diameter of the upper body 310 into a recess formed along an inner diameter of the lower body 312. This retention key 326B extending into the recess in the lower body 312 may hold the lower body 312 in a particular orientation relative to the upper body 310 during the initial landing of the tree 18 and before the release of the spring 314. As shown, the retention key 326B extending into the recess of the lower body 312 may be aligned in a radial direction with the trip key 326A in the lower body 312.

As the tree 18 (along with the upper body 310 and lower body 312) is lowered toward the wellhead 12, the upper body 310 and lower body 312 are received through an initial opening 328 of the tubing hanger 14. This initial opening 328 may have a bore with a diameter that is slightly larger than the outer diameter of the lower body 312. As such, the trip key 326A is able to stay in the outwardly extended position. As the tree 18 continues lowering, the upper body 310 and lower body 312 may pass from the opening 328 into a portion 330 of the tubing hanger 14 having a relative smaller diameter bore that is just large enough to receive the lower body 312. The tubing hanger 14 may feature a trip shoulder 332 at the boundary between the larger bore initial opening 328 and the smaller bore portion 330. As the lower body 312 passes into the smaller bore portion 330 of the tubing hanger 14, the trip key 326A may be brought into contact with the trip shoulder 332, which presses the trip key 326A radially inward. This radially inward movement of the trip key 326A simultaneously forces the retention key 326B out of the recess in the lower body 312 such that the retention key 326B no longer holds the lower body 312 in rotational alignment with the upper body 310. This allows the lower body 312 to now rotate relative to the upper body 310 as urged by the previously set torsional spring 314.

The final spring loaded key 326C may function as an alignment key to stop rotation of the lower body 312 when the lower body 312 reaches the proper orientation relative to the tubing hanger 14. The alignment key 326C may be attached to the lower body 310 and biased in a radially outward direction. During rotation of the lower body 310 relative to the upper body 312 in response to force exerted by the torsional spring 314, the alignment key 326C may be held in place within a recess in the lower body 312 by the inner wall of the relatively smaller bore portion 330 of the tubing hanger 14. The lower body 312 may rotate until the alignment key 326C reaches a position that is rotationally aligned with a slot 334 formed in the inner diameter of the tubing hanger 14. The slot 334 may be vertically oriented, as shown. Once the alignment key 326C is aligned with the slot 334, the key 326C is biased radially outward into the slot 334, thereby halting rotation of the lower body 312 at a desired position relative to the tubing hanger 14.

The lower body 312 may be a solid piece that houses hydraulic, electric, and/or fiber optic couplings 336 designed to interface directly with those couplings 32 on the tubing hanger 14. The couplings 336 may be a standard design, or they may be an actuated design so that they can make up linear differences in elevations between the bottom of the lower body 312 and the top of the tubing hanger 14. As mentioned above, the lower body 312 may include one or more hydraulic ports 324 routed to the hydraulic gallery 322 so as to allow rotation of the lower body 312 relative to the upper body 310. Electric couplings at the bottom of the lower body 312 may be wired to a series of dry mate electric contacts (not shown) that sit between the upper body 310 and the lower body 312. These electric contacts may allow rotation of the lower body 312 with respect to the upper body 310. The lower body 310 may also house the alignment key 326C and the retention key 326B of the trigger assembly 316.

In the embodiments of FIGS. 2-12, fiber optic communications between fiber optic cables in the tubing hanger 14 and tree 18 may be converted to an electric signal inside the tubing hanger alignment device 16 and then reconverted to fiber optic (light) communication on the output side of the tubing hanger alignment device 16.

A general description of a method for operating the tubing hanger alignment device 16 of FIGS. 11 and 12 will now be described. The upper body 310 (along with the attached lower body 312, torsional spring 314, and trigger assembly 316) may be installed into a lower portion of the tree 18, similar to the way a production stab sub is installed in a traditional tree. During assembly, the torsional spring 314 is wound and the trigger assembly 316 is set, effectively storing rotational energy in the alignment assembly.

The tubing hanger 14 may be run in any orientation and locked into place within the wellhead 12. The tree 18 (with connected alignment device 16) may then be run and oriented into a desired location prior to landing. While landing the tree 18, the trigger assembly 316 of the alignment device 16 trips out on the trip shoulder 332 in the inner diameter of the tubing hanger 14 to release the spring 314, as described at length above. Once the torsional spring 314 is released, the lower body 312 is able to rotate until the spring loaded alignment key 326C enters the mating slot 334 in the inner diameter of the tubing hanger 14. Once the lower body 312 is rotationally locked into the alignment slot 334, the hydraulic, electric, and/or fiber optic couplings 336 may be engaged with the corresponding couplings 32 of the tubing hanger 14. The hydraulic, electric, and/or fiber optic couplings between the tree 18 and the tubing hanger 14 will then be tested to ensure a proper connection has been made.

Figure 11:
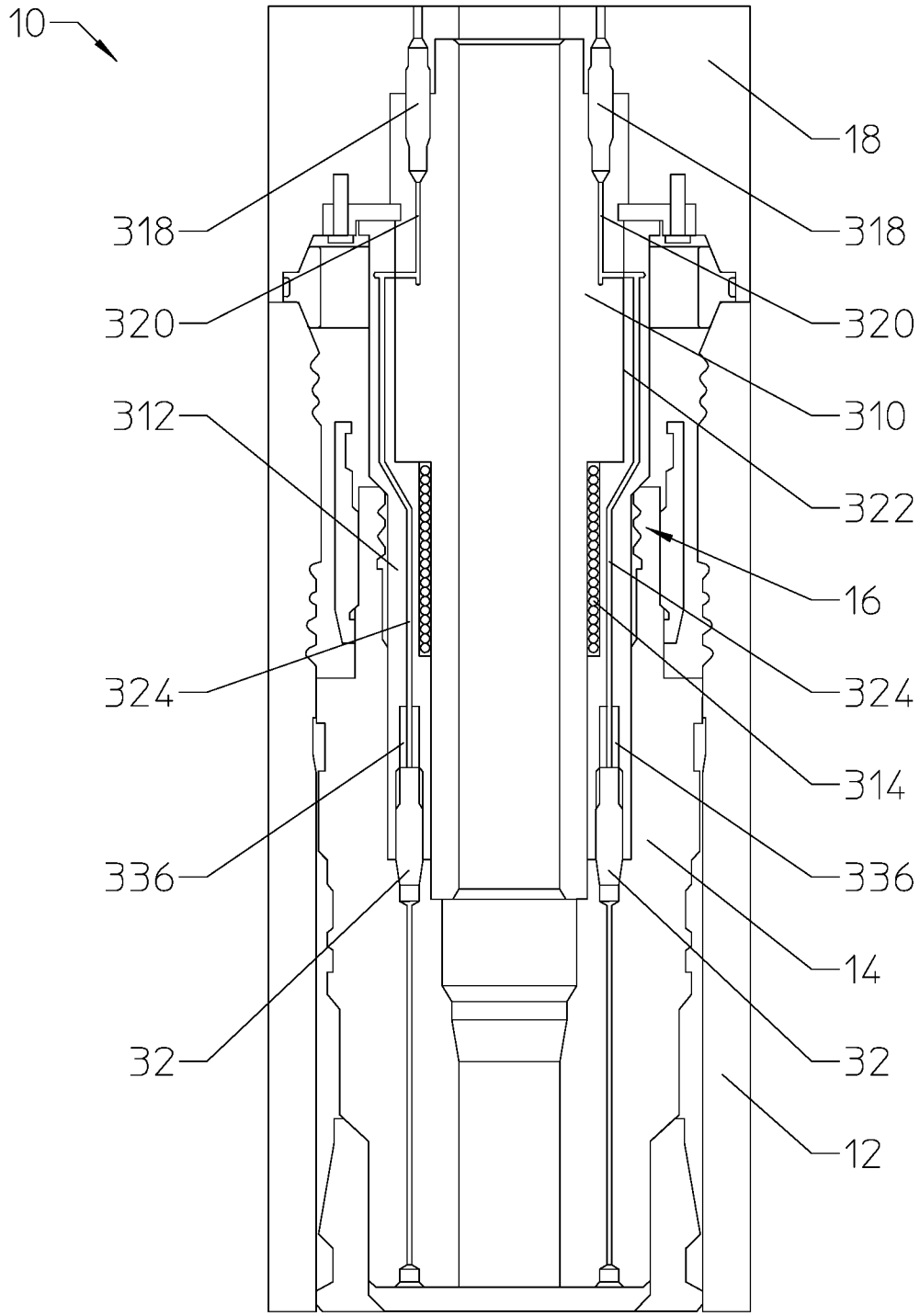
FIG. 11 is a cross-sectional view of a production system comprising a tubing hanger alignment device with a torsional spring alignment mechanism, in accordance with an embodiment of the present disclosure.

The disclosed tubing hanger alignment device 16 of FIGS. 11 and 12 may achieve the goal of aligning the tubing hanger penetrations (i.e., couplings/stabs 32 and 336) independent of the orientation about the longitudinal axis in which the tree 18 is landed. Existing tree body designs do not have to be modified to accommodate the disclosed tubing hanger alignment device 16. Existing tubing hangers may be utilized with only a minor modification to add the alignment slot 334, but otherwise this alignment device 16 utilizes standard interfaces to the tree 18 and the tubing hanger 14.

Plug-Based Alignment Mechanism

A tubing hanger alignment device 16 having a plug-based alignment mechanism will be described with reference to FIGS. 13-18. The tubing hanger alignment device 16 of FIG. 13 includes an alignment sleeve 510 and a plug assembly 512, among other things. The arrangement and interaction of these components will now be described.

The alignment sleeve 510 may be a solid piece that is located within and interfaces with an inner surface of a main bore of the tree 18. The alignment sleeve 510 may be directly coupled to a production stab sub 516 of the tree 18 and held in place relative to the sub 514 via a shear pin 516 or other type of shear mechanism. The tree 18 may include standard hydraulic, electric, and/or fiber optic couplings 518 designed to interface directly with the couplings 32 on the tubing hanger 14.

Turning to FIGS. 14-18, the plug assembly 512 may include an inner plug body 520, an outer plug body 522, an orientation sleeve 524, a retaining bolt 526, a locking mechanism 528, an actuation mechanism 530, a seal or packing element 532, a tapered gear/spline 534, an anti-rotation key 535, and shear pins 536 and 538. The plug assembly 512 may be entirely separate from the tree 18 and the tubing hanger 14 and may be utilized to orient the tree 18 relative to the tubing hanger 14 after being placed, locked, and/or adjusted within a bore of the tubing hanger 14.

The inner plug body 520 is generally disposed within the outer plug body 522, as shown. The outer plug body 522 may include two components that are connected (e.g., via threads 540) together to define a cavity 542 within which the inner body 520 is partially captured. A distal portion 544 of the inner body 520 may extend outside the cavity 542 in one direction, and this distal portion 544 may have a bore formed therethrough. A connecting portion 546 of the orientation sleeve 524 may be received within the bore in the distal portion 544 of the inner plug body 520, and the retaining bolt 526 may be positioned through the connecting portion 546 of the orientation sleeve 524 and coupled directly to the inner body 520 via threads. As such, the retaining bolt 526 may couple the orientation sleeve 524 to the inner plug body 520. It should be noted that other arrangements of an orientation sleeve and one or more plug bodies may be utilized in other embodiments of the disclosed plug assembly 512.

The locking mechanism 528 may include a set of locking dogs or a split ring, or any other type of lock as known to one of ordinary skill in the art. The locking mechanism 528 may be disposed at least partially around an outer edge of the inner body 520 and may extend into and/or through at least one slot 548 formed radially through the outer body 522. This allows the locking mechanism 528 to be actuated into locking engagement with a radially inner surface of the tubing hanger 14 so as to lock the plug assembly 512 in place within the tubing hanger 14. A generally sloped surface 550 forming a radially outer edge of the inner plug body 520 may be used to hold the locking mechanism 528 into its extended locking position until it is time to remove the plug assembly 512 from the tubing hanger 14.

The actuation mechanism 530 may be used to actuate the plug and thereby set the locking mechanism 528 within the tubing hanger 14. The actuation mechanism 530 may include an actuation button 552 and a split ring 554 (or similar type of actuation ring). The actuation mechanism 530 may function as follows. The split ring 554 may be biased in a radially outward direction. When the plug assembly 512 is being run in, the split ring 554 may be held within two opposing recesses 556 and 558 formed in a radially outer surface of the inner body 520 and a radially inner surface of the outer body 522, respectively. In this position, the split ring 554 may generally prevent the inner body 520 and outer body 522 from moving relative to each other in an axial direction. The actuation button 552 may be positioned through the wall of the outer body 522 and have a flat surface extending into the recess 558 of the outer body 522.

When the plug assembly 512 is run into the tubing hanger 14, a shoulder 560 (FIG. 13) on the inner edge of the tubing hanger 14 may abut the actuation button 552, forcing the button 552 radially inward such that the button 552 compresses the split ring 554 fully into the recess 556 of the inner plug body 520. With the split ring 554 in this collapsed position, the inner body 520 is free to move axially downward relative to the outer body 522 in response to setting pressure placed on the plug assembly 512 by a running tool 574. This downward movement causes the sloped surface 550 of the inner body 520 to push radially outward against the locking mechanism 528, thereby setting the locking mechanism 528 into a locking groove 564 (FIG. 13) on the internal surface of the tubing hanger 14. The downward movement of the inner body 520 may also set the spring loaded shear pin 536 into a recess formed along the inner surface of the outer plug body 522. This shear pin 536 may keep the inner plug body 520 in the same axial position relative to the outer plug body 522 to maintain the plug assembly 512 in this locked position within the tubing hanger 14 until it is time to remove the plug assembly 512.

The seal or packing element 532 located at the lower end of the outer plug body 522 is used to provide a high pressure seal within the bore of the tubing hanger 14. When the plug assembly 512 enters the locked position, the seal or packing element 532 is energized. The seal or packing element 532 may seal the tubing hanger 14 so that the BOP can be removed from the wellhead, and replaced by the tree 18, while maintaining two high pressure seals in the system (one via a downhole safety valve and a backup via the plug 512).

The tapered gear/spline 534 may be disposed at the intersection of the connecting portion 546 of the orientation sleeve 524 and the inner body 520. The tapered gear/spline mechanism 534 may include threads that enable an incremental adjustment of the orientation (e.g., by 1 degree, 2 degrees, or some other amount) of the orientation sleeve 524 about the longitudinal axis relative to the rest of the plug assembly 512. The outer plug body 522 may be held rotationally in place via the anti-rotation key 535 fitted in a corresponding slot of the tubing hanger 14 when the plug assembly 512 is in the locked position. At this point, a running and/or adjustment tool disposed inside and engaged with running/adjustment grooves 566 of the orientation sleeve 524 may pick up the orientation sleeve 524 and rotate the orientation sleeve 524 relative to the outer and inner bodies of the plug. This rotation may be performed in an incremental fashion in accordance with the relative size and number of threads present in the tapered gear/spline mechanism 534. The retaining bolt 526 may be sized and positioned such that the orientation sleeve 524 can move axially back and forth as needed during this adjustment process. The orientation of the sleeve 524 is so that the sleeve 524 can be brought into a desired rotational alignment with respect to the wellhead 12. An ROV based tool or some other type of tool may be used to determine how far the orientation sleeve 524 has been adjusted within the wellhead.

The orientation sleeve 524 includes an orientation profile 568 formed along a distal end of the orientation sleeve 524. The orientation profile 568 may include, for example, a slanted end surface and a series of different sized slots 570 extending through the orientation sleeve 524. The alignment sleeve 510 on the tree 18 may feature a complementary profile 572 designed to fit into the orientation profile 568 of the orientation sleeve 524 when the alignment sleeve 510 (and consequently tree 18) are brought into a desired alignment with the orientation sleeve 524. The slots 50 may each have different widths so as to only allow mating engagement of the alignment sleeve 510 with the orientation sleeve 524 in a single orientation of the parts relative to each other. The alignment sleeve 510 may rotate until it is brought into this desired orientation. In this orientation, the couplings 518 on the tree 18 will be directly aligned with the couplings 32 on the tubing hanger 14. The slots 570 may be elongated in a vertical direction, as shown, so that the tree couplings 518 can be brought into the correct alignment with the tubing hanger couplings 32 first and then be lowered directly downward to form a mating connection.

It should be noted that other types or arrangements of an orientation profile 568 on the orientation sleeve 524 and complementary profile 572 on the alignment sleeve 510 may be utilized in other embodiments. For example, the orientation profile 568 may be a helix and the alignment sleeve 572 may include a pin designed to be received into the helix and directed therethrough until the tree 18 is brought into alignment and a mating connection with the tubing hanger 14.

A general description of a method for operating the tubing hanger alignment device 16 of FIGS. 13-18 will now be described. The tubing hanger 14 may be run in the wellhead 12 through the BOP while the BOP is in place. The plug assembly 512 may then be lowered through the wellhead 12 and into the bore of the tubing hanger 14. The BOP is removed only after the plug assembly 512 is installed, and the plug assembly 512 remains in place until the tree 18 has been landed. After the tree 18 is landed, the plug assembly 512 may be removed and reused.

Figure 14:
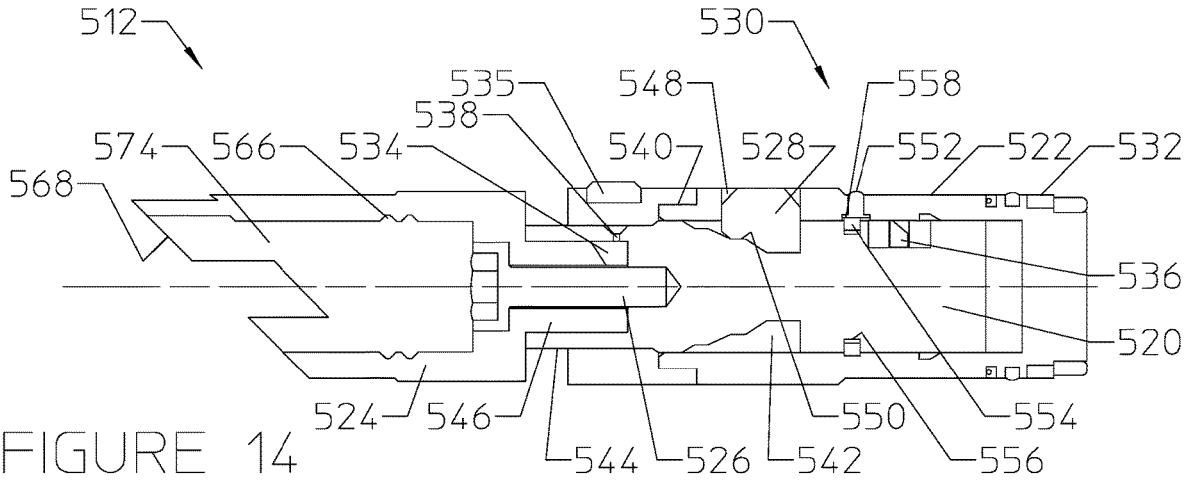
FIG. 14 is a cross-sectional view of a plug assembly used in the tubing hanger alignment device of FIG. 13 in a running position, in accordance with an embodiment of the present disclosure.

FIG. 14 shows the plug assembly 512 during the running operation. As mentioned above, while being run in, the locking mechanism 528 is in the collapsed state, the actuation mechanism 530 is unactuated, and the shear pin 536 is not engaged. A running tool 574 is positioned within the bore of the orientation sleeve 524 and connected to the orientation sleeve 524 via the running/adjustment grooves 566. As the running tool 574 lowers the plug assembly 512 into the tubing hanger 14, the running tool 574 may rotate the plug assembly 512 until it reaches an orientation where the anti-rotation key 535 is positioned in the corresponding slot of the tubing hanger 14.

Figure 15:
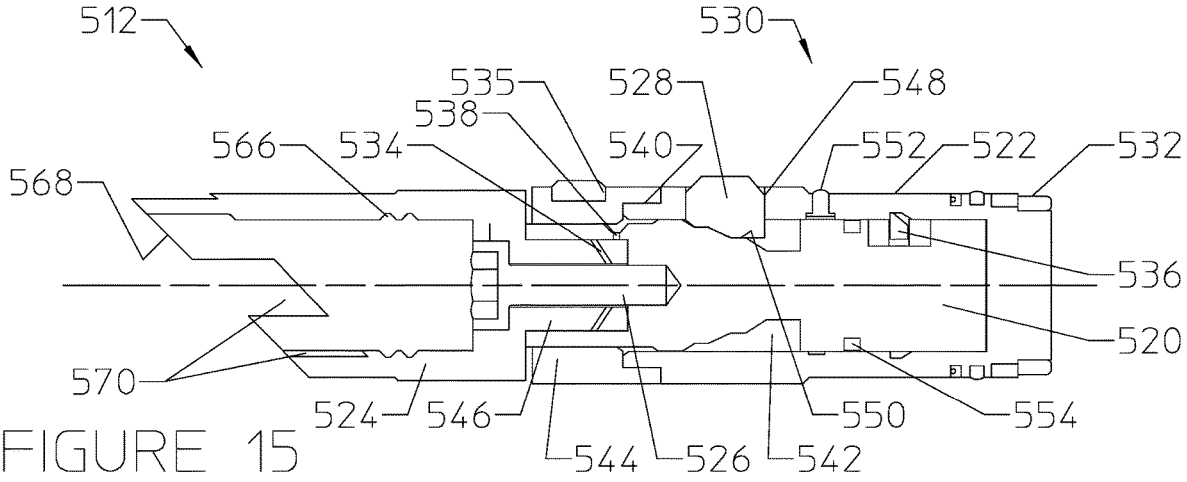
FIG. 15 is a cross-sectional view of the plug assembly of FIG. 14 being locked into a tubing hanger, in accordance with an embodiment of the present disclosure.

Further lowering of the plug assembly 512 will cause the plug assembly 512 to lock into the tubing hanger 14, as shown in FIG. 15. The shoulder 560 on the tubing hanger 14 may press against the actuation button 552, actuating the locking mechanism 528 so that the split ring 554 is received into the locking groove 564 of the tubing hanger 14. The shear pin 536 may spring outward into the recess formed in the outer plug body 522. As a result, the plug assembly 512 is locked in the tubing hanger 14. The seal or packing element 532 may be engaged with the inner diameter of the tubing hanger bore so as to provide a back-up for the downhole safety valve once the BOP is removed. The anti-rotation key 535 located in the slot of the tubing hanger 14 prevents the seal or packing element 532 from rotating.

Figure 16:
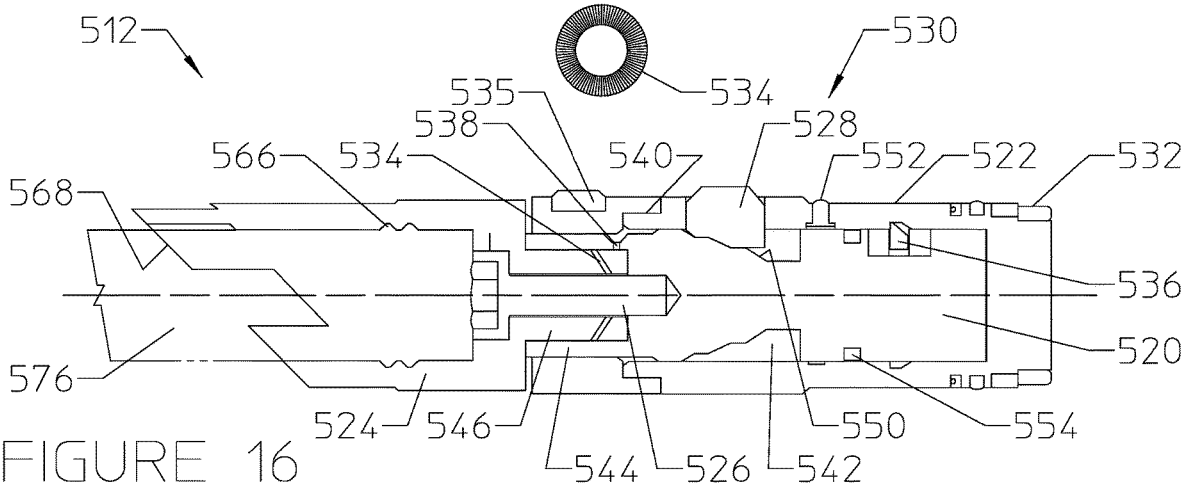
FIG. 16 is a cross-sectional view of the plug assembly of FIGS. 14 and 15 with an alignment sleeve being adjusted, in accordance with an embodiment of the present disclosure.
Figure 17:
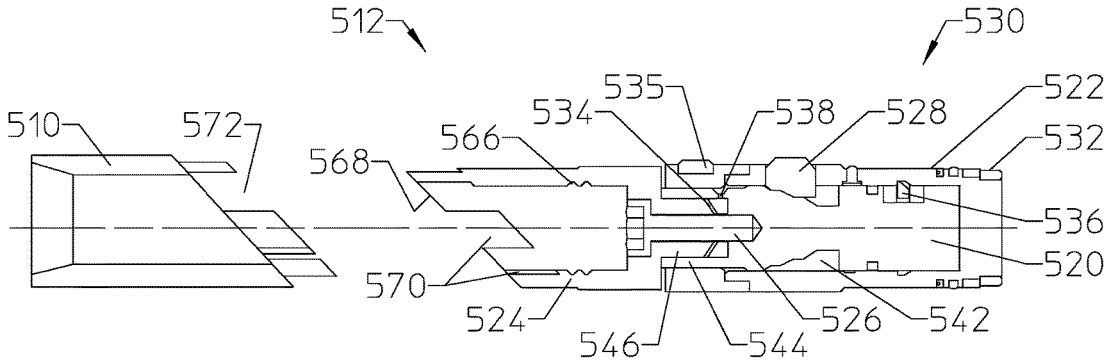
FIG. 17 is a cross-sectional view of a tree component being landed on the plug assembly of FIGS. 14-16, in accordance with an embodiment of the present disclosure.
Figure 18:
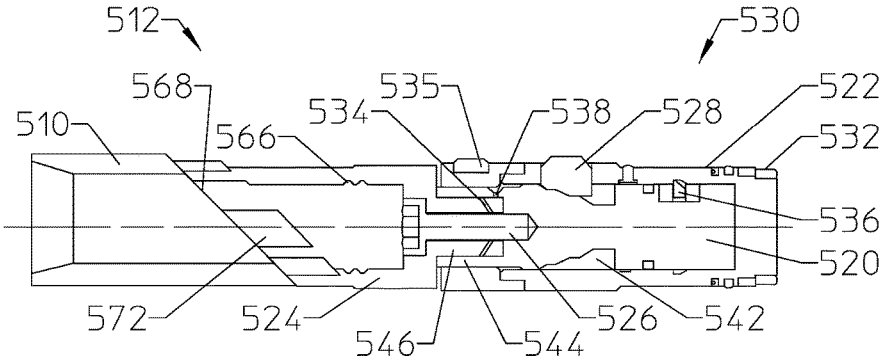
FIG. 18 is a cross-sectional view of the tree component being landed and aligned with the tubing hanger via the plug assembly of FIGS. 14-17, in accordance with an embodiment of the present disclosure.

Once the plug assembly 512 is locked, the BOP may be removed from the wellhead 12. The orientation sleeve 524 may be adjusted relative to the rest of the plug 512, as shown in FIG. 16. An adjustment tool 576, which may or may not be the same as the running tool described above, is positioned within the bore of the orientation sleeve 524 and connected to the orientation sleeve 524 via the running/adjustment grooves 566. As the adjustment tool 576 rotates the orientation sleeve 524 relative to the rest of the plug, the tapered gear/spline 534 guides this rotation to take place in small increments, which can be tracked by an outside tool. Whatever adjustment has been made to place the orientation sleeve 524 in a desired orientation relative to the wellhead, the same rotational adjustment may then be made on the tree 18 (e.g., between the alignment sleeve 510 and other portions of the tree 18). This adjustment of the tree 18 will enable direct connections between the tree couplings 518 and the tubing hanger couplings 32 to be made.

The tree 18 (illustrated just as the alignment sleeve 510 in FIGS. 17 and 18) may then be landed onto the wellhead 12. The alignment of the tree 18 relative to the tubing hanger 14 is guided by the orientation profile 568 on the orientation sleeve 524 interfacing with the complementary profile 572 on the alignment sleeve 510. Once the slots and corresponding legs of these profiles 568 and 572 are matched up, further lowering of the tree 18 onto the wellhead 12 will cause the alignment sleeve 510 to lower vertically through the elongated slots in the orientation sleeve 524, thereby providing a controlled descent of the tree couplings 518 onto the appropriate tubing hanger couplings 32. The tree 18 at this point is landed and the connections between the tree 18 and the tubing hanger 14 are made up.

After the tree is landed, the plug assembly 512 may be removed. The plug assembly 512 may be reusable in different wellheads once it is removed. To remove the plug assembly 512, a retrieval tool may be coupled to the orientation sleeve 524 and used to pull the plug upward. This upward force may cause the spring-loaded shear pin 536 to shear, thereby releasing the inner body 520 from its axial position within the outer body 522. The inner body 520 may be lifted up within the outer body 522, causing the sloped surface 550 to move out of the outwardly biasing contact with the locking mechanism 528. The locking mechanism 528 may collapse into the recess in the outer body 522, freeing the plug 512 to be extracted from the bore of the tubing hanger 14.

Although the present disclosure and its advantages have been described in detail, it should be understood that various changes, substitutions and alterations can be made herein without departing from the spirit and scope of the disclosure as defined by the following claims.

What is claimed is:

1. A system, comprising:

a tubing hanger positioned in a wellhead, wherein the tubing hanger comprises one or more hydraulic, electric, or fiber optic couplings;

a tubular housing comprising one or more hydraulic, electric, or fiber optic lines disposed therein;

a removable plug for placement within the tubing hanger, wherein the removable plug comprises an orientation profile extending therefrom when the plug is seated and locked into the tubing hanger; and an alignment sleeve disposed in a main bore of the tubular housing, wherein the alignment sleeve comprises a complementary orientation profile for interacting with the removable plug, wherein interaction of the orientation profiles on the alignment sleeve and the plug cause the one or more hydraulic, electric, or fiber optic lines of the tubular housing to be aligned with the one or more hydraulic, electric, or fiber optic couplings of the tubing hanger.

2. The system of claim 1, wherein the plug is configured to be actuated into a locked position with respect to the tubing hanger in response to an actuation button of the plug contacting a shoulder on an inner edge of the tubing hanger, wherein actuating the plug into the locked position comprises moving a generally sloped surface on the plug in an axial direction with respect to a locking mechanism of the plug to hold the locking mechanism in contact with the tubing hanger.

3. The system of claim 1, wherein the plug further comprises an anti-rotation key configured to fit in a corresponding slot of the tubing hanger when the plug is seated and locked into the tubing hanger.

4. The system of claim 1, wherein the orientation profile of the plug comprises a slanted end surface and a series of vertically oriented slots extending through a distal end of the plug.

5. The system of claim 1, wherein the plug further comprises a tapered gear/spline mechanism including threads that enable an incremental adjustment of the orientation of the orientation profile about a longitudinal axis of the plug.

6. The system of claim 1, wherein the tubular housing comprises one of a tree body, a spool, or a flowline connection body.

7. A plug assembly configured to be removably positioned in a tubing hanger of a wellhead system, the plug assembly comprising:

a seal disposed proximate a first longitudinal end of the plug assembly and configured to seal a bore of the tubing hanger;

a locking mechanism configured to removably lock the plug assembly against the bore of the tubing hanger; and an orientation sleeve comprising an orientation profile proximate a second longitudinal end of the plug assembly opposite the first longitudinal end, the orientation profile configured to receive a complementary profile of a tree being landed on the tubing hanger, wherein the orientation sleeve is rotationally adjustable with respect to a body of the plug assembly in a rotational direction around the longitudinal axis of the plug assembly.

8. The plug assembly of claim 7, wherein the orientation profile comprises a slanted end surface and a series of vertically oriented slots extending through the distal end of the plug assembly.

9. The plug assembly of claim 7, further comprising:

an outer plug body, wherein the locking mechanism is disposed at least partially within a slot through the outer plug body; and an inner plug body disposed within the outer plug body, wherein the inner plug body comprises a generally sloped surface configured to set the locking mechanism in a locked position in response to an axial movement of the generally sloped surface with respect to the outer plug body.

10. The plug assembly of claim 9, further comprising an actuation mechanism comprising:

an actuation button disposed along the outer plug body; and a split ring disposed between the inner plug body and the outer plug body, wherein forcing the actuation button in a radially inward direction causes the split ring to compress into a recess of the inner plug body such that the inner plug body is axially movable with respect to the outer plug body.

11. The plug assembly of claim 9, further comprising:

a spring loaded shear pin coupled to the inner plug body and configured to be set into a recess formed along an inner surface of the outer plug body to keep the inner plug body in an axial position relative to the outer plug body.

12. The plug assembly of claim 7, further comprising a tapered gear/spline mechanism including threads that enable an incremental rotational adjustment of the orientation sleeve with respect to the other portion of the plug assembly.

13. A method, comprising:

running a tubing hanger through a blowout preventer (BOP) into a wellhead;

lowering a plug assembly through the wellhead and into a bore of the tubing hanger;

removing the BOP from the wellhead after the plug assembly is installed in the tubing hanger; and landing a tubular housing on the wellhead such that one or more hydraulic, electric, or fiber optic lines of the tubular housing are aligned with one or more hydraulic, electric, or fiber optic couplings on the tubing hanger, wherein the plug assembly orients the tubular housing with respect to the tubing hanger during landing of the tubular housing.

14. The method of claim 13, wherein landing the tubular housing on the wellhead comprises landing one of a tree body, a spool, or a flowline connection body on the wellhead.

15. The method of claim 13, further comprising locking the plug assembly into the tubing hanger via a locking mechanism of the plug assembly.

16. The method of claim 15, further comprising actuating the locking mechanism by axially moving an inner plug body having a sloped surface with respect to an outer plug body having the locking mechanism disposed therein.

17. The method of claim 13, rotationally adjusting an orientation of an orientation sleeve of the plug assembly with respect to the tubing hanger after lowering the plug assembly into the bore of the tubing hanger.

18. The method of claim 17, further comprising rotationally adjusting a portion of the tubular housing by a same amount as the rotational adjustment of the orientation sleeve of the plug assembly prior to landing the tubular housing.

19. The method of claim 13, further comprising removing the plug assembly from the bore of the tubing hanger.

* * * * *